US011174633B2

(12) United States Patent
Mordechai et al.

(10) Patent No.: US 11,174,633 B2
(45) Date of Patent: Nov. 16, 2021

(54) MODULAR CONSTRUCTION SYSTEM AND METHOD OF USE THEREOF

(71) Applicant: Trango-Sys Ltd., Kibbutz Ein Hanatzive (IL)

(72) Inventors: Hagai Mordechai, Nof Harim (IL); Eitan Ben Gad, Jerusalem (IL); Yehuda Hillman, Haifa (IL); Avi Skovlevitz, Kiryat Ono (IL)

(73) Assignee: Trango-Sys Ltd., Kibbutz Ein Hanatzive (IL)

( * ) Notice: Subject to any disclaimer, the term of this patent is extended or adjusted under 35 U.S.C. 154(b) by 0 days.

(21) Appl. No.: 17/151,732

(22) Filed: Jan. 19, 2021

(65) Prior Publication Data

US 2021/0131096 A1 May 6, 2021

Related U.S. Application Data

(60) Provisional application No. 62/986,839, filed on Mar. 9, 2020.

(51) Int. Cl.
*E04B 2/14* (2006.01)
*E04B 1/48* (2006.01)
(Continued)

(52) U.S. Cl.
CPC ..... *E04B 2/14* (2013.01); *A63H 33/067* (2013.01); *E04B 1/32* (2013.01); *E04B 1/48* (2013.01);
(Continued)

(58) Field of Classification Search
CPC ..... E04B 2/14; E04B 1/48; E04B 1/32; E04B 2001/327; E04B 1/34384; E04B 1/34321;
(Continued)

(56) References Cited

U.S. PATENT DOCUMENTS 4,677,797 A * 7/1987 Roth ..... E04B 1/34321 52/282.3
4,858,398 A * 8/1989 Ricchini ..... E04B 1/14 52/91.3
(Continued)

FOREIGN PATENT DOCUMENTS

DE 2605237 A1 * 8/1977 ..... E04B 1/6158
EP 1304420 4/2003
(Continued)

*Primary Examiner* — Brian D Mattei
*Assistant Examiner* — Matthew J Gitlin
(74) *Attorney, Agent, or Firm* — Michael J. Feigin, Esq.; Feigin and Fridman LLC

(57) ABSTRACT

A modular construction system, including, first and second walls, each having first and second broad surfaces. Each wall includes throughgoing connector-receiving bores. The modular construction system further includes a connector including a longitudinal body portion arranged along a longitudinal axis and having a first width. A head portion of the longitudinal body portion includes a base surface having a second width in a direction transverse to the longitudinal axis. A pair of protrusions extend outwardly from the longitudinal body portion and are disposed between the base surface and a tail end of the longitudinal body portion. The protrusions include an engagement surface facing toward the base surface and having a third width, the third width being greater than the first width.

20 Claims, 24 Drawing Sheets

(51) Int. Cl.
*E04B 1/32* (2006.01)
*A63H 33/06* (2006.01)
*E04B 1/61* (2006.01)

(52) U.S. Cl.
CPC ..... *E04B 1/6145* (2013.01); *E04B 2001/327* (2013.01); *E04F 2201/0529* (2013.01)

(58) Field of Classification Search
CPC .. E04B 1/34315; E04B 1/6183; E04B 1/1903; E04B 1/6145; E04B 1/6154; E04B 1/6158; E04B 1/6162; E04B 2002/0243; E04B 2002/0245; E04B 2002/0252; A63H 33/067; A63H 33/008; A63H 33/0088; A63H 33/044; A63H 33/107; E04F 2201/0529
See application file for complete search history.

(56) References Cited

U.S. PATENT DOCUMENTS 4,918,879 A 4/1990 Bodurow et al.
9,395,103 B2 * 7/2016 Conley ..... H02S 20/00
9,724,618 B2 * 8/2017 Ben Shalom ..... B32B 25/14
10,072,411 B1 9/2018 Moran et al.
10,890,001 B2 * 1/2021 Hollmann ..... E04G 9/05
2005/0063775 A1 * 3/2005 Boltz ..... H02G 3/0608 403/397
2009/0272876 A1 * 11/2009 McNamara ..... E04G 17/02 249/192
2011/0290307 A1 * 12/2011 Workman ..... H02S 40/34 136/251
2013/0104490 A1 * 5/2013 Daudet ..... E04B 1/1903 52/655.1
2014/0033631 A1 * 2/2014 Rokk ..... E04B 1/34321 52/582.2
2016/0032581 A1 * 2/2016 Sklar ..... E04B 1/1903 52/220.8
2018/0135670 A1 * 5/2018 Fleming, III ..... F16B 5/0036
2018/0345642 A1 12/2018 Ben Shalom
2020/0054958 A1 * 2/2020 Gallagher ..... A63H 33/108

FOREIGN PATENT DOCUMENTS

EP 1304420 A1 * 4/2003 ..... E04B 2/7448
FR 1311416 A * 12/1962 ..... E04B 1/6158
FR 1518492 A * 3/1968 ..... E04B 1/6162
FR 2616183 A1 * 12/1988 ..... F16B 12/125
WO 2010/037938 4/2010

* cited by examiner 600
608
606
604
602

608
606
604

604
602

MODULAR CONSTRUCTION SYSTEM AND METHOD OF USE THEREOF

FIELD AND BACKGROUND OF THE INVENTION

The invention, in some embodiments, relates to the field of construction systems, and more specifically to a construction systems for building modular, durable, structures for human use.

Models of life size structures are used in many industries. For example, in the theatres and video industries, three dimensional life size structures may be created as sets. In the gaming industry, three dimensional life size structures maybe created to prepare virtual reality games, or may be formed for players to travel through, such as for example during laser-tag or paint-ball games, or in escape rooms.

In order to make these games interesting, and to ensure that patrons do not get bored and memorize the existing structures, it is often desired to periodically change the layout of the structures in which the game is played. To facilitate this, it is desirable that the materials used to build the model structures be modular, such that different structures can be easily assembled and disassembled.

Modular structures may also be useful in disaster relief efforts, for example to put up temporary shelter for people in areas struck by disasters that ruin housing, such as areas struck by earthquakes, storms, and floods.

Various types of systems for building life size structures exist in the art. Some are based on building blocks, similar to large Lego® blocks. However, these structures have the disadvantage of requiring many pieces to construct, and consequently construction of large structures is highly time consuming, and requires detailed planning and skill.

Other systems provide multiple large building blocks, such as "wall" building blocks, that connect to each other using corresponding protrusions and indentations. However, in such prior art systems, connected elements are not locked to one another and can easily disconnect during use thereof, which may cause them to topple over people interacting with the structure, such as people playing laser tag within a built maze.

As such, there is a need in the art for a modular construction system which allows users to build temporary, yet sturdy, life size modular structures, that can be easily and quickly assembled and disassembled.

SUMMARY OF THE INVENTION

In accordance with an embodiment of the disclosed technology, there is provided a modular construction system, including:

first and second walls, each having a first broad surface and a second broad surface, distal to the first broad surface, each including at least one throughgoing connector-receiving bore, the connector-receiving bores having a first dimension in a first axial direction, and a second dimension in a second axial direction, perpendicular to the first axial direction, the first dimension being greater than the second dimension; and a connector, including:

a longitudinal body portion arranged along a longitudinal axis and having a first width, in a direction transverse to the longitudinal axis, the longitudinal body having a head end and a tail end, the first width being equal to or smaller than the second dimension of the connector-receiving bores;

a head portion disposed at the head end of the longitudinal body portion, the head portion including a base surface facing toward the tail end of the longitudinal body portion, the base surface having a second width in a direction transverse to the longitudinal axis, the second width being greater than the first width and being equal to, or smaller than, the first dimension of the connector-receiving bores; and a pair of protrusions, extending outwardly from the longitudinal body portion in the direction transverse to the longitudinal axis, the protrusions being disposed, along the longitudinal body portion, between the base surface of the head portion and the tail end of the longitudinal body portion, the protrusions including an engagement surface facing toward the base surface and having a third width in the direction transverse to the longitudinal axis, the third width being greater than the first width.

In some embodiments, the connector is separate and distinct from each of the first and second walls.

In some embodiments, a distance between the base surface and the engagement surface, along the longitudinal axis of the longitudinal body portion, is equal to a sum of thicknesses of the first and second walls.

In some embodiments, the third width is greater than the first dimension of the connector-receiving bores.

In some embodiments, the base surface and the engagement surface are substantially perpendicular to one another.

In some embodiments, the first and second walls form part of a single unitary structural element. In some such embodiments, the single unitary structural element includes at least one non-planar wall. In some such embodiments, the connector is separate and distinct from the single unitary structural element.

In some embodiments, the first wall is part of a first structural element, and the second wall is part of a second structural element, different from the first structural element. In some such embodiments, the first and second structural elements are the same type of element. In some other such embodiments, the first and second structural elements are different types of structural elements. In some such embodiments, the connector is separate and distinct from the first and the second structural elements.

In some embodiments, at least one of the first and second structural elements includes at least one non-planar wall. In some embodiments, the non-planar wall is an arched wall.

In some embodiments, the connector is rigid. In some such embodiments, the connector is not compressible to a degree perceivable by a human.

In accordance with another embodiment of the disclosed technology, there is provided a three dimensional structure constructed using the modular construction system as described herein, wherein:

the first broad surfaces of the first and second walls are disposed adjacent one another, such that connector-receiving bores of the first and second walls are substantially aligned;

the base surface of the connector is disposed adjacent the second broad surface of the first wall;

the engagement surface of the protrusions of the connector is disposed adjacent the second broad surface of the second wall; and a segment of the longitudinal body portion, between the base surface and the engagement surface, extends through the substantially aligned connector-receiving bores of the first and second walls.

In some embodiments, the first broad surfaces of the first and second walls engage one another.

In some embodiments, the base surface engages the second broad surface of the first wall. In some embodiments the engagement surface engages the second broad surface of the second wall.

In some embodiments, a width of the base surface is perpendicular to the first axial direction of the aligned connector-receiving bores. In some embodiments, a width of the engagement surface is perpendicular to the first axial direction of the aligned connector-receiving bores.

In some embodiments, the longitudinal axis of the connector is perpendicular to the second broad surfaces of the first and second walls.

In accordance with yet another embodiment of the disclosed technology there is provided a method for building a three dimensional structure using the modular construction system as described herein, the method including:

aligning the connector-receiving bores of the first and second walls, such that the first broad surfaces of the first and second walls are adjacent one another;

aligning the connector alongside the aligned connector-receiving bores, such that the head portion of the connector is adjacent to one of the aligned connector-receiving bores, the connector being oriented such that a width of the base surface is aligned with the first axial direction of the aligned connector-receiving bores and the longitudinal axis of the connector is perpendicular to the first axial direction of the aligned connector-receiving bores;

inserting the connector into the aligned connector-receiving bores, until the engagement surface is adjacent the second broad surface of the second wall, and the head portion extends out of the aligned connector-receiving bores with the base surface being adjacent to the second broad surface of the first wall; and rotating the connector such that, following rotation, the width of the base surface is substantially perpendicular to the first axial direction, and the first and second walls are disposed between the base surface and the engagement surface.

In some embodiments, following the rotating, the engagement surface engages the second broad surface of the second wall, and the base surface engages the second broad surface of the first wall.

In some embodiments, following the rotating, the first and second walls have substantially no degree of freedom in a direction along the longitudinal axis of the connector.

BRIEF DESCRIPTION OF THE FIGURES

Some embodiments of the invention are described herein with reference to the accompanying figures. The description, together with the figures, makes apparent to a person having ordinary skill in the art how some embodiments of the invention may be practiced. The figures are for the purpose of illustrative discussion and no attempt is made to show structural details of an embodiment in more detail than is necessary for a fundamental understanding of the invention. For the sake of clarity, some objects depicted in the figures are not to scale.

In the Figures.

DESCRIPTION OF SOME EMBODIMENTS OF THE INVENTION

Figure 1B:
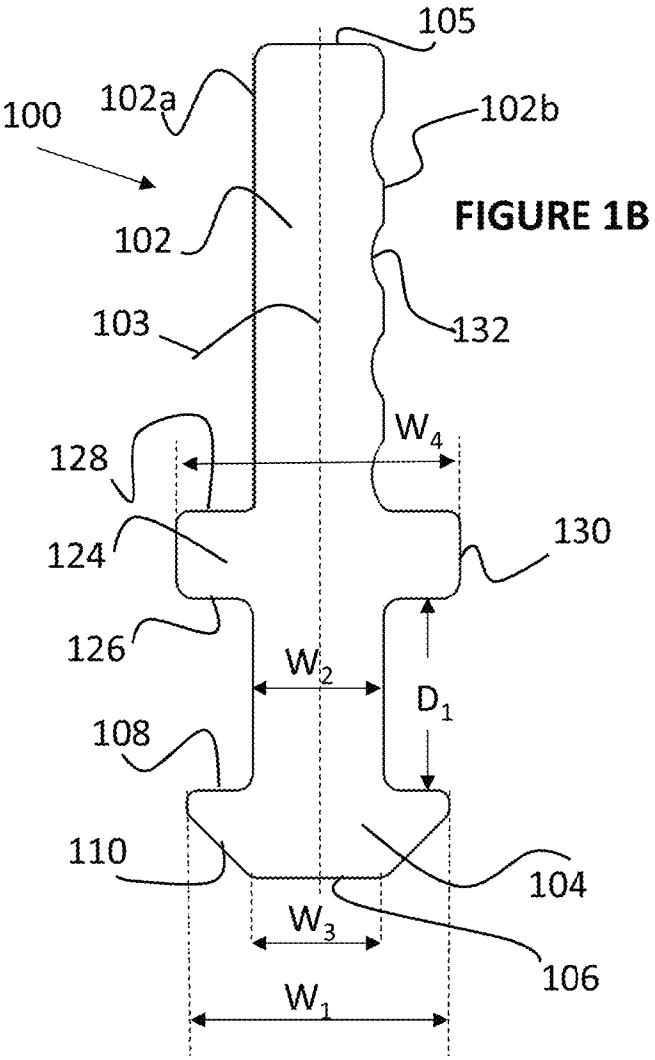
FIGS. 1A, 1B, and 1C are, respectively, a perspective view illustration, a planar front view illustration, and a planar side view illustration of a connector forming part of a modular construction system according to an embodiment of the teachings herein.

The invention, in some embodiments, relates to the field of construction systems, and more specifically to a construction systems for building modular, durable, structures for human use.

The principles, uses and implementations of the teachings herein may be better understood with reference to the accompanying description and figures. Upon perusal of the description and figures present herein, one skilled in the art is able to implement the invention without undue effort or experimentation.

Before explaining at least one embodiment of the invention in detail, it is to be understood that the invention is not limited in its applications to the details of construction and the arrangement of the components and/or methods set forth in the following description and/or illustrated in the drawings and/or the Examples. The invention can be implemented with other embodiments and can be practiced or carried out in various ways. It is also understood that the phraseology and terminology employed herein is for descriptive purpose and should not be regarded as limiting.

Figure 1A:
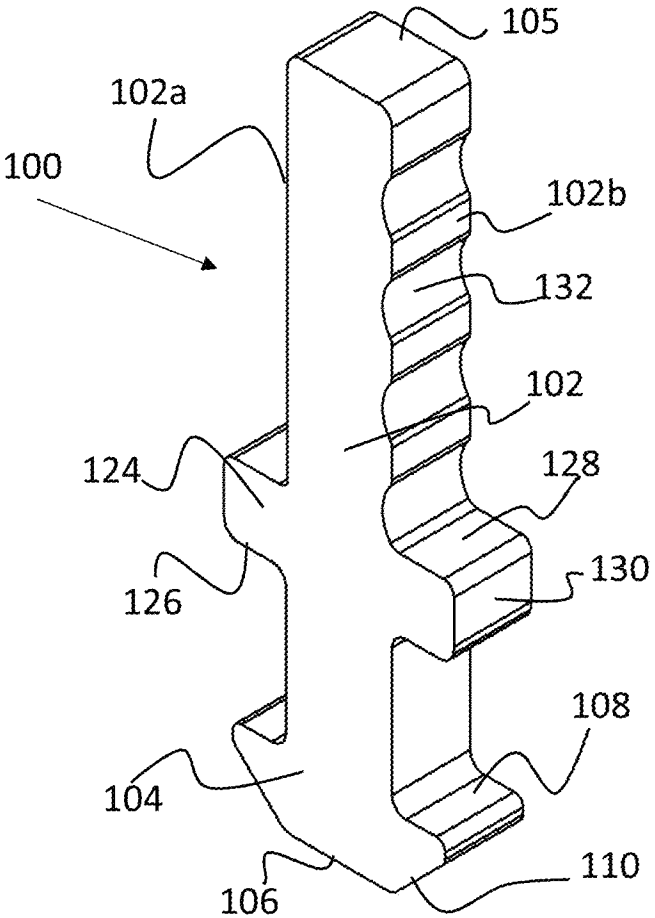
Figure 1D:
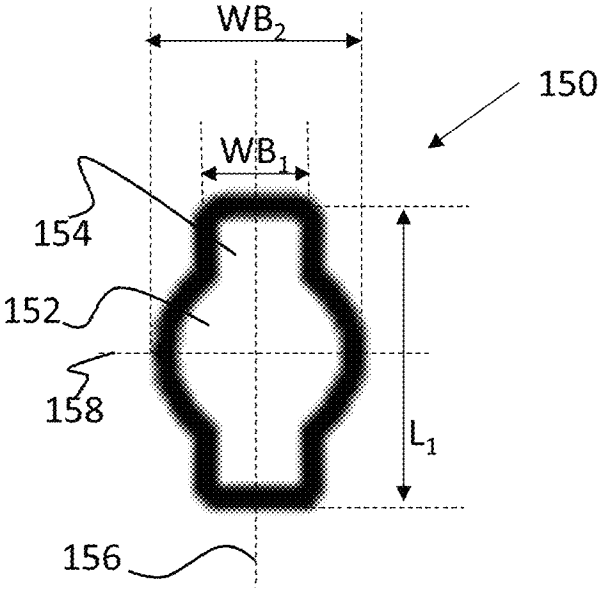
FIG. 1D is a schematic illustration of the shape of a connector-receiving bore according to an embodiment of the teachings herein, for receiving the connector of FIGS. 1A to 1C.
Figure 1C:
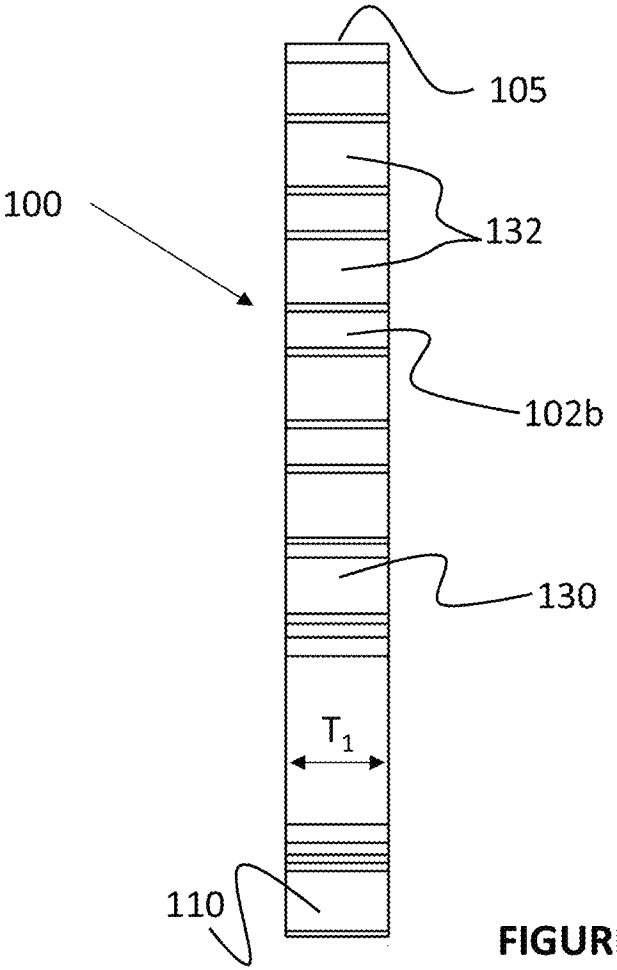

Reference is now made to FIGS. 1A, 1B, and 1C, which are, respectively, a perspective view illustration, a planar front view illustration, and a planar side view illustration of a connector 100 forming part of a modular construction system according to an embodiment of the teachings herein.

As seen, connector 100 includes a longitudinal body portion 102, having a first side 102*a* and a second side 102*b*, and arranged along a longitudinal axis 103. Longitudinal body portion 102 terminates at one end in a head portion 104, and at an opposing end in an end wall 105. As seen, head portion 104 includes an end surface 106, a base surface 108, and slanted side surfaces 110 connecting end surface 106 with base surface 108 to form a substantially trapezoidal shape. Base surface 108 extends outwardly from sides 102*a* and 102*b* of longitudinal body portion 102, substantially perpendicularly thereto.

A pair of protrusions 124 extend outwardly from longitudinal body portion 102, in a direction transverse to a longitudinal axis of longitudinal body portion 102. Typically, protrusions 124 are disposed parallel to one another along the length of longitudinal body portion 102. Each protrusion 124 includes a first surface 126, facing toward base surface 108 of head portion 104, and a second surface 128, facing toward end wall 105 of longitudinal body portion 102. Side surface 130 connect surfaces 126 and 128 of each of protrusions 124. Typically, surfaces 126 and 128 are substantially perpendicular to first and second sides 102*a* and 102*b*, and are substantially parallel to each other and to base surface 108.

As seen, first side 102*a* is generally planar, while second side 102*b* includes a plurality of indentations 132 in a section thereof between second surface 128 and end wall 105. As explained in further detail hereinbelow, indentations 132 are designed to accommodate the fingers of the user during use of connector 100. However, in some embodiments, indentations 132 may be obviated, and in such embodiments second side 102*b* would be symmetric to first side 102*a*.

A width $W_1$ of base surface 108 is greater than a width $W_2$ of longitudinal body portion 102. In the illustrated embodiment, also a width $W_3$ of end surface 106 is greater than width $W_2$ of longitudinal body portion 102. A width $W_4$ of surface 126 is greater than width $W_2$ of the longitudinal body portion.

In some embodiments, width $W_4$ of surface 126 is substantially equal to width $W_1$ of base surface 108. However, in other embodiments, width $W_4$ may be greater than, or smaller than, width $W_1$ of base surface 108, provided that it remains larger than width $W_2$ of longitudinal body portion 102.

In the illustrated embodiment, surface 128 has substantially the same width as surface 126. However, in some embodiments, surface 128 may be wider than surface 126 or narrower than surface 126.

As explained in further detail hereinbelow, it is a particular feature of the teachings herein that a distance $D_1$ between base surface 108 and surface 126 is substantially equal to twice a width of wall portions of elements of the modular construction system, for example as described hereinbelow with respect to FIGS. 2A to 5D.

In some embodiments, the thickness of the connector 100, indicated by T1, is in the range of 5 mm-60 mm, or in the range of 15 mm to 45 mm.

In some embodiments, connector 100 is formed of, or includes, one or more metals.

In some embodiments, connector 100 is formed of, or includes, a cardboard and/or paperboard material.

In some embodiments, connector 100 is formed of, or includes, a wood based material.

In some embodiments, connector 100 is formed of, or includes, a plastic material.

In some embodiments, connector 100 is formed of, or includes, a polymeric material, such as polyethylene, polyolefin, and the like. The polymeric material may be a foamed polymeric material, a cross-linked polymeric material, and the like.

In some embodiments, the connector 100 may be formed of a multi-layer material, or may comprise multiple layers of different materials. For example, the connector 100 may be formed of a multi-layer polymeric material, e.g. as described in US Patent Application Publication No. 2018/0345642, filed Jan. 17, 2017, which is incorporated herein by reference as if fully set forth herein.

In some embodiments, connector 100 is rigid, and is incompressible. In the context of the present application, the term "incompressible" is defined as "not compressible to a degree perceivable by the human eye, without use of special measurements or tools".

Reference is now made to FIG. 1D, which is a schematic illustration of the shape of a connector-receiving bore 150 according to an embodiment of the teachings herein, for receiving the connector 100 of FIGS. 1A to 1C.

As seen in FIG. 1D, according to some embodiments, the connector-receiving bore 150 has a generally circular (or oval) center portion 152, having two indentations 154 extending from opposing ends thereof. As such, connector-receiving bore 150 is symmetrical about a longitudinal axis 156, as well as about a transverse axis 158, perpendicular to the longitudinal axis 156.

The length $L_1$ of the bore, along the longitudinal axis, greater than the greatest width of head portion 104 of the connector 100 (FIGS. 1A to 1C), which may be width $W_1$ of base surface 108, or the width of end surface 106.

The width of bore 150 at the indentations 154, indicated by $WB_1$, is greater than the thickness of connector 100. The width of bore 150 at center portion 152, indicated by $WB_2$, is greater than the width $W_2$ of longitudinal body portion 102 of the connector, but smaller than both width $W_1$ of base surface 108 of the connector and width $W_4$ of surface 126 of the connector. These dimensions facilitate locking two walls of structural elements of the system within the distance $D_1$ of the connector 100, as explained in detail hereinbelow.

Reference is now made to FIGS. 2A, 2B, 2C, 2D, and 2E, which are, respectively, a perspective view illustration, a planar front view illustration, a planar back view illustration, a planar side view illustration, and a planar top view illustration of a rectangular wall element 200 forming part of a modular construction system according to an embodiment of the teachings herein.

As seen in FIGS. 2A to 2E, the rectangular wall element 200 is a three dimensional structure, having a front wall 202, a back wall 204, side walls 206, and top and bottom walls 208. The two side walls 206 are substantially mirror images of one another, and the top and bottom walls 208 are substantially mirror images of one another.

Each of the walls of rectangular element 200 includes a plurality of connector-receiving bores 210, equivalent to bores 150 of FIG. 1D. As seen, in each of the walls of wall element 200, the longitudinal axes of the bores 210 coincide with, or are parallel to, the longitudinal axis of the wall. As such, all the bores 210 in a single wall are oriented in the same direction, while the bores 210 in two perpendicular walls may be oriented in opposing directions—see for example bore 210*a* in front wall 202 and bore 210*b* in top wall 208.

In some embodiments, one or more of the walls may include multiple rows and/or multiple columns of bores 210, as seen for example in front wall 202 and in back wall 204. The distances between the bores, and the exact positioning of the bores, may be selected as suitable for the specific application. However, in some embodiments, it is desirable that the distances between the bores be fixed, or at least the distances between some of the bores be fixed, to facilitate easier connection between elements of different dimensions, as explained in further detail hereinbelow.

For example, in the illustrated embodiment, all the bores are disposed at one of two distances from each other, the distances being labeled as Dc for the closer bores, and Df for the bores that are farther apart. As seen, the distance Dc and Df are used in all walls of element 200, both in the longitudinal direction thereof and along the width thereof.

In some embodiments, the distance Dc is in the range of 100 mm to 200 mm, or in the range of 120 mm to 180 mm. In some embodiments, the distance Dc is 150 mm.

In some embodiments, the distance Df is in the range of 350 mm to 500 mm, or in the range of 400 mm to 450 mm. In some embodiments, the distance Df is 425 mm.

In some embodiments, back wall 204 of rectangular wall element 200 includes a plurality of cutout portions 212, disposed between pairs of adjacent bores 210. The locations and dimensions of cutout portions 212 are selected to enable the user to insert his or her hand into the rectangular wall element 200 for manipulation of the connector connecting the wall element to another element of the construction system, as explained in further detail hereinbelow.

In some embodiments, the length of the front, back, and side walls is significantly greater than, and in the illustrated embodiment exactly double, the width of the front and back walls and the length of the top and bottom walls. In some embodiments, the width of the side walls and of the top and bottom walls is significantly smaller than the width of the front and back walls, such that the element 200 forms a narrow "box".

In some embodiments, the aspect ratio between the length of the front wall portion 202 and the width of the front wall portion 202 is in the range of 4:1 to 1.25:1, or in the range of 3:1 to 1.5:1. In some embodiments, aspect ratio between the length of the front wall portion 202 and the width of the front wall portion 202 is 2:1.

In some embodiments, the thickness of each wall of rectangular wall element 200 is in the range of 10 mm-60 mm, or in the range of 25 mm to 45 mm.

In some embodiments, the dimensions of rectangular wall element 200 are 2000 mm height, 1000 mm width, and 150 mm thickness. However, any other dimensions, suitable for life-size use, are considered within the scope of the present invention.

Figure 2B:
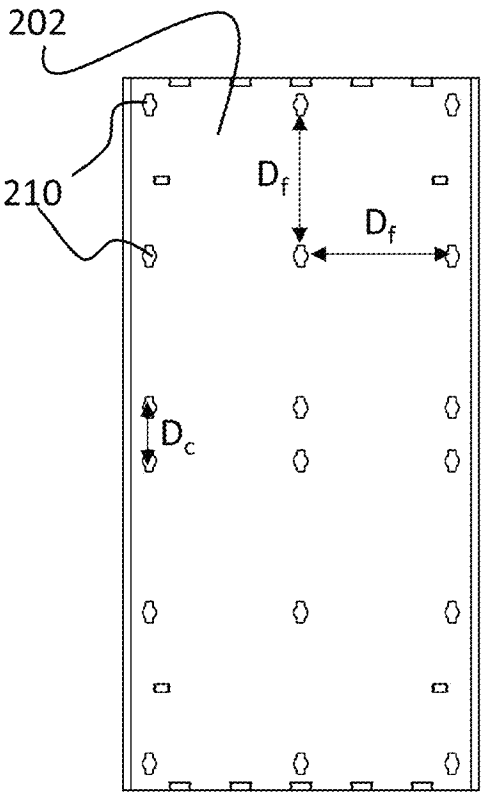
FIGS. 2A, 2B, 2C, 2D, and 2E are, respectively, a perspective view illustration, a planar front view illustration, a planar back view illustration, a planar side view illustration, and a planar top view illustration of a rectangular wall element forming part of a modular construction system according to an embodiment of the teachings herein.
Figure 2A:
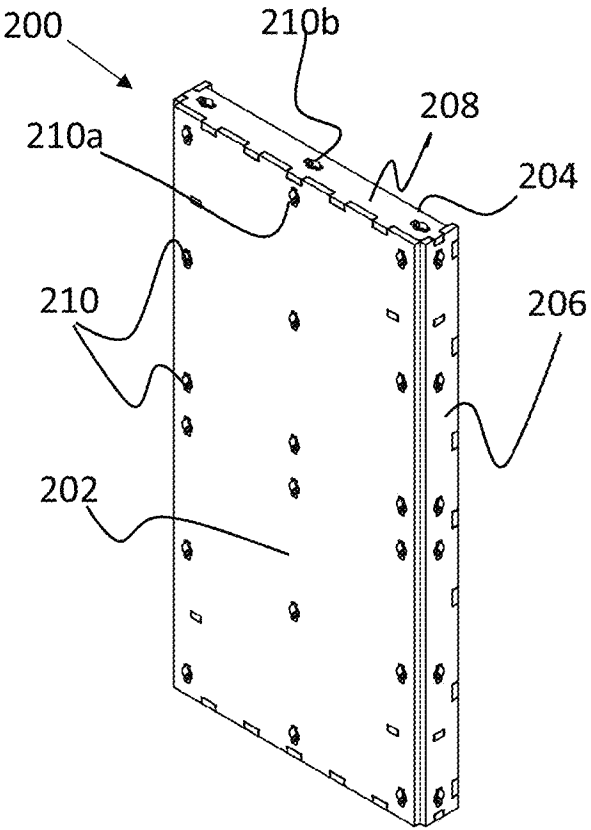
Figure 2E:
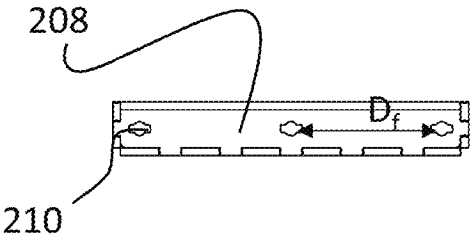
Figure 2D:
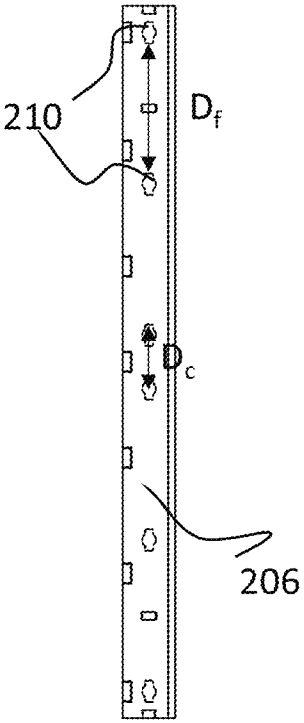
Figure 2C:
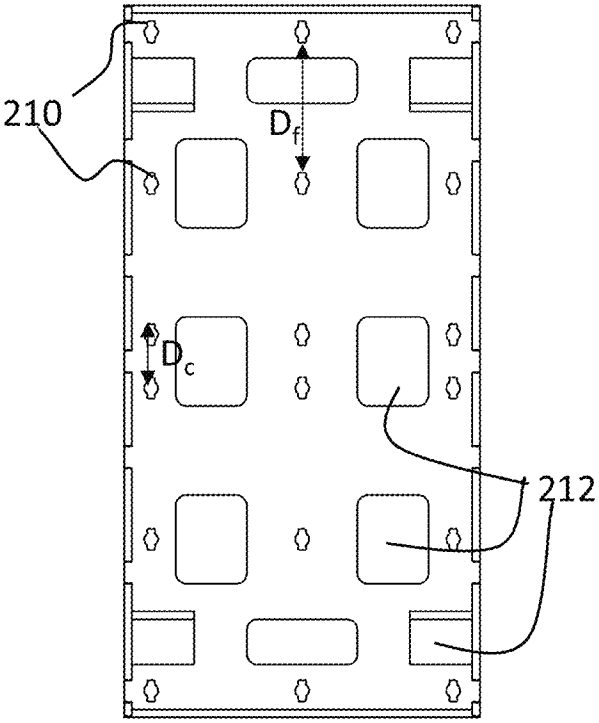

In some embodiments, rectangular wall element 200 is manufactured as the hollow three-dimensional construct illustrated in FIG. 2A. In such embodiments, the user is not required to construct, or form any connections, between any of the walls of the rectangular wall element 200.

In other embodiments, rectangular wall element 200 is manufactured as a unitary spread planar element which is a spread of all the walls of element 200. In such embodiments, hinges are provided along the connection points between two walls, for example at the connection point between the length of a side wall 206 and the length of front wall 202. In such embodiments, prior to use, the spread planar element is folded, and suitable edges thereof are connected to one another to form the rectangular wall element of FIG. 2A, either at the factory or by the user.

In yet other embodiments, rectangular wall element 200 is manufactured as multiple planar portions, for example as six planar portions each comprising one of the walls of rectangular wall element 200. In such embodiments, edges of the multiple planar portions are connected to one another to form the rectangular wall element of FIG. 2A, prior to use, either at the factory or by the user.

In the embodiment which require connection of walls of the rectangular wall element 200 to each other after manufacturing thereof, such as the second and third embodiments provided herein, the walls may be connected to each other using any suitable means, such as snap fit engagement, adhering, soldering, using mechanical fasteners, and the like.

In some embodiments, rectangular wall element 200 is formed of, or includes, one or more metals.

In some embodiments, rectangular wall element 200 is formed of, or includes, a cardboard and/or paperboard material.

In some embodiments, rectangular wall element 200 is formed of, or includes, a wood based material.

In some embodiments, rectangular wall element 200 is formed of, or includes, a plastic material.

In some embodiments, rectangular wall element 200 is formed of, or includes, a polymeric material, such as polyethylene, polyolefin, and the like. The polymeric material may be a foamed polymeric material, a cross-linked polymeric material, and the like.

In some embodiments, rectangular wall element 200 may be formed of a multi-layer material, or may comprise multiple layers of different materials. For example, rectangular wall element 200 may be formed of a multi-layer polymeric material, e.g. as described in US Patent Application Publication No. 2018/0345642, filed Jan. 17, 2017, which is incorporated herein by reference as if fully set forth herein.

In some embodiments, all the walls of rectangular wall element 200 are formed of a single material, whereas in other embodiments different walls of a single rectangular wall element 200 may be formed of different materials.

Reference is now made to FIGS. 3A, 3B, 3C, 3D, and 3E, which are, respectively, a perspective view illustration, a planar front view illustration, a planar back view illustration, a planar side view illustration, and a planar top view illustration of a square wall element forming part of a modular construction system according to an embodiment of the teachings herein.

As seen in FIGS. 3A to 3E, the square wall element 300 is a three dimensional structure, having a front wall 302, a back wall 304, side walls 306, and top and bottom walls 308. The two side walls 306 are substantially mirror images of one another, and the top and bottom walls 308 are substantially mirror images of one another.

Each of the walls of square element 300 includes a plurality of connector-receiving bores 310, equivalent to bores 150 of FIG. 1D. As seen, in each of the walls of wall element 300, the longitudinal axes of the bores 310 coincide with, or are parallel to, the longitudinal axis of the wall. As such, all the bores 310 in a single wall are oriented in the same direction, while the bores 310 in two perpendicular walls may be oriented in opposing directions—see for example bore 310*a* in front wall 302 and bore 310*b* in top wall 308.

In some embodiments, one or more of the walls may include multiple rows and/or multiple columns of bores 310, as seen for example in front wall 302 and in back wall 304. The distances between the bores, and the exact positioning of the bores, may be selected as suitable for the specific application. However, in some embodiments, it is desirable that the distances between the bores be fixed, or at least the distances between some of the bores be fixed, to facilitate easier connection between elements of different dimensions, as explained in further detail hereinbelow.

For example, in the illustrated embodiment, all the bores are disposed at the same distance from each other, the distance being labeled as Df. As seen, the distance Df is used in all walls of element 300, both in the longitudinal direction thereof and along the width thereof. In some embodiments, the distance Df of square wall element 300 is equal to the distance Df of rectangular wall element 200 (FIGS. 2A to 2E) to facilitate connection of different types of walls to each other, as explained in further detail hereinbelow.

In some embodiments, the distance Df is in the range of 350 mm to 500 mm, or in the range of 400 mm to 450 mm. In some embodiments, the distance Df is 425 mm.

In some embodiments, back wall 304 of square wall element 300 includes a plurality of cutout portions 312, disposed between pairs of adjacent bores 310. The locations and dimensions of cutout portions 312 are selected to enable the user to insert his or her hand into the square wall element 300 for manipulation of the connector connecting the wall element to another element of the construction system, as explained in further detail hereinbelow.

Figure 3B:
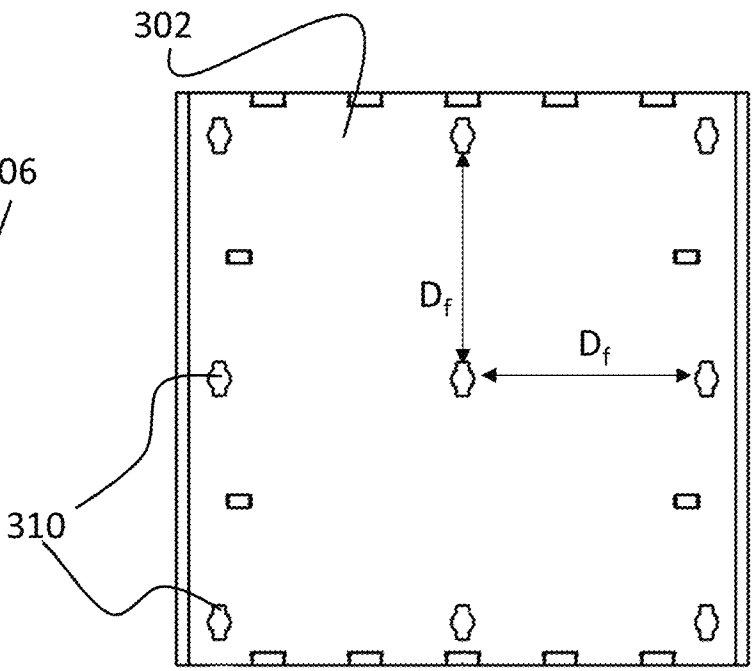
FIGS. 3A, 3B, 3C, 3D, and 3E are, respectively, a perspective view illustration, a planar front view illustration, a planar back view illustration, a planar side view illustration, and a planar top view illustration of a square wall element forming part of a modular construction system according to an embodiment of the teachings herein.
Figure 3A:
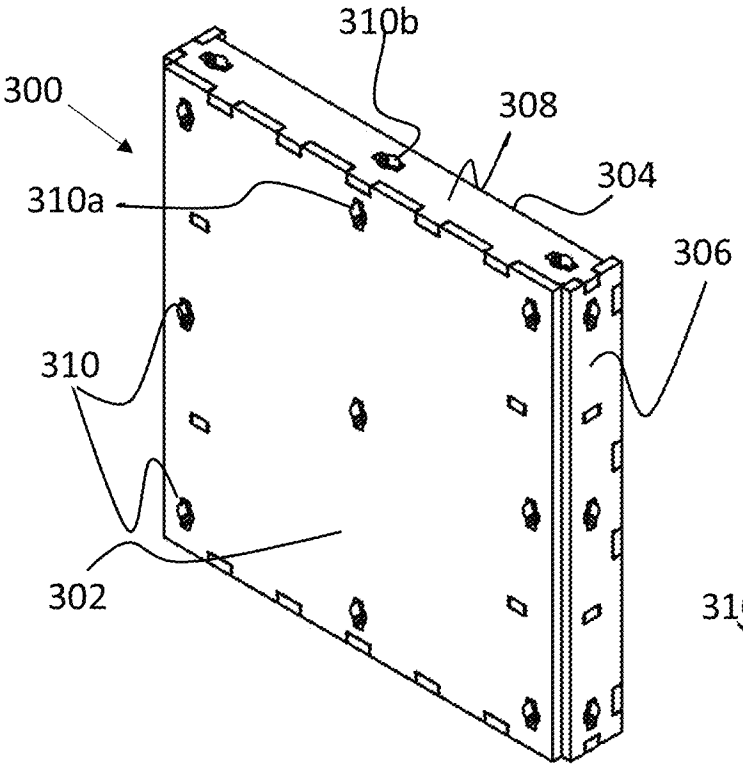
Figure 3C:
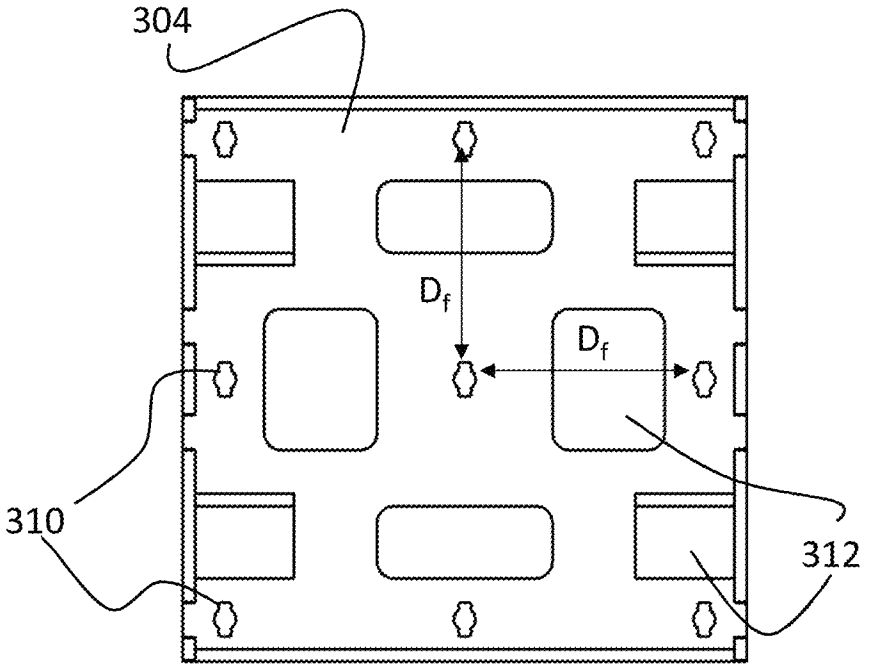
Figure 3D:
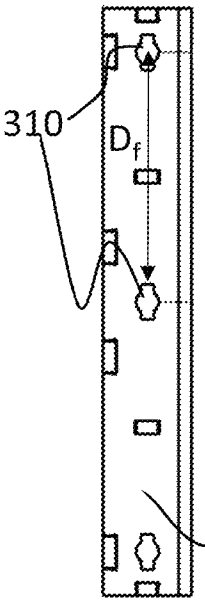
Figure 3E:
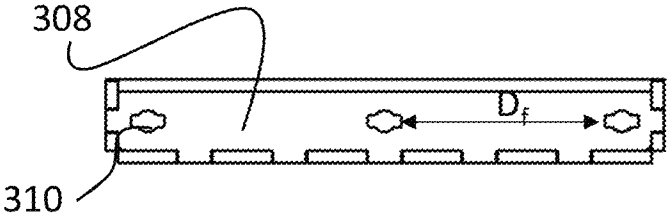

In some embodiments, the width of the side walls and of the top and bottom walls is significantly smaller than the length and width of the front and back walls, such that the element 300 forms a narrow "box", as seen in FIG. 3A.

In some embodiments, square wall element 300 is manufactured as the hollow three-dimensional construct illustrated in FIG. 3A. In such embodiments, the user is not required to construct, or form any connections, between any of the walls of the square wall element 300.

In other embodiments, square wall element 300 is manufactured as a unitary spread planar element which is a spread of all the walls of element 300. In such embodiments, hinges are provided along the connection points between two walls, for example at the connection point between the length of a side wall 306 and the length of front wall 302. In such embodiments, prior to use, the spread planar element is folded, and suitable edges thereof are connected to one another to form the square wall element of FIG. 3A, either at the factory or by the user.

In yet other embodiments, square wall element 300 is manufactured as multiple planar portions, for example as six planar portions each comprising one of the walls of square wall element 300. In such embodiments, edges of the multiple planar portions are connected to one another to form the square wall element of FIG. 3A, prior to use, either at the factory or by the user.

In the embodiment which require connection of walls of the square wall element 300 to each other after manufacturing thereof, such as the second and third embodiments provided herein, the walls may be connected to each other using any suitable means, such as snap fit engagement, adhering, soldering, using mechanical fasteners, and the like.

In some embodiments, the thickness of each wall of square wall element 300 is in the range of 10 mm-60 mm, or in the range of 25 mm to 45 mm.

In some embodiments, the dimensions of square wall element 300 are 1000 mm height and width, and 150 mm thickness. However, any other dimensions, suitable for life-size use, are considered within the scope of the present invention.

In some embodiments, square wall element 300 is formed of, or includes, one or more metals.

In some embodiments, square wall element 300 is formed of, or includes, a cardboard and/or paperboard material.

In some embodiments, square wall element 300 is formed of, or includes, a wood based material.

In some embodiments, square wall element 300 is formed of, or includes, a plastic material.

In some embodiments, square wall element 300 is formed of, or includes, a polymeric material, such as polyethylene, polyolefin, and the like. The polymeric material may be a foamed polymeric material, a cross-linked polymeric material, and the like.

In some embodiments, square wall element 300 may be formed of a multi-layer material, or may comprise multiple layers of different materials. For example, square wall element 300 may be formed of a multi-layer polymeric material, e.g. as described in US Patent Application Publication No. 2018/0345642, filed Jan. 17, 2017, which is incorporated herein by reference as if fully set forth herein.

In some embodiments, all the walls of square wall element 300 are formed of a single material, whereas in other embodiments different walls of a single square wall element 300 may be formed of different materials.

Reference is now made to FIGS. 4A, 4B, 4C, 4D, and 4E, which are, respectively, a perspective view illustration, a planar front view illustration, a planar back view illustration, a planar side view illustration, and a planar top view illustration of a square window element forming part of a modular construction system according to an embodiment of the teachings herein.

As seen in FIGS. 4A to 4E, the square window element 400 is a three dimensional structure, having a square front wall 402 and a square back wall 404, each having a window opening 405 therein. Square window element 400 further includes side walls 406, and top and bottom walls 408, all connecting front wall 402 with back wall 404. The two side walls 406 are substantially mirror images of one another, and the top and bottom walls 408 are substantially mirror images of one another. Top, bottom, and side window frame walls 409 connect front wall 402 and back wall 404 along four edges of window openings 405.

In the illustrated embodiments, window openings 405 are rectangular, and are concentric with front wall 402 and back wall 404. However, in some embodiments, window openings 405 may be located at a different position within the front and back walls. Typically, the window openings 405 in the front and back walls are equal in their dimensions, and are disposed parallel to one another, such that each of window frame walls 409 is either substantially horizontal or substantially vertical. However, in some embodiments, window openings 405 may have different shape (e.g. triangular, circular), may be of different dimensions, and/or may be disposed at locations of front wall 402 and back wall 404 that are not parallel to each other. In such embodiments, each of window frame walls 409 may be slanted and/or curved.

Each of the frame walls of square window element 400 (namely the front, back, top, bottom, and side walls) includes a plurality of connector-receiving bores 410, equivalent to bores 150 of FIG. 1D. As seen, in each of the walls of window element 400, the longitudinal axes of the bores 410 coincide with, or are parallel to, the longitudinal axis of the wall. As such, all the bores 410 in a single wall are oriented in the same direction, while the bores 410 in two perpendicular walls may be oriented in opposing directions—see for example bore 410*a* in front wall 402 and bore 410*b* in top wall 408.

In some embodiments, one or more of the walls may include multiple rows and/or multiple columns of bores 410, as seen for example in front wall 402 and in back wall 404. The distances between the bores, and the exact positioning of the bores, may be selected as suitable for the specific application. However, in some embodiments, it is desirable that the distances between the bores be fixed, or at least the distances between some of the bores be fixed, to facilitate easier connection between elements of different dimensions, as explained in further detail hereinbelow.

In some embodiments, window frame walls 409 may be devoid of bores 410, as in the illustrated embodiment. However, in other (non illustrated) embodiments, some bores 410 may be formed in one or more of window frame walls 409, for example for mounting of an obstacle or game target in the window.

For example, in the illustrated embodiment, all the bores are disposed at the same distance from each other, the distance being labeled as Df. As seen, the distance Df is used in all walls of element 400, both in the longitudinal direction thereof and along the width thereof. In some embodiments, the distance Df of square window element 400 is equal to the distance Df of rectangular wall element 200 (FIGS. 2A to 2E) to facilitate connection of different types of walls to each other, as explained in further detail hereinbelow.

In some embodiments, the distance Df is in the range of 350 mm to 500 mm, or in the range of 400 mm to 450 mm. In some embodiments, the distance Df is 425 mm.

In some embodiments, back wall 404 of square window element 400 includes a plurality of cutout portions 412, disposed between pairs of adjacent bores 410. The locations and dimensions of cutout portions 412 are selected to enable the user to insert his or her hand into the square window element 400 for manipulation of the connector connecting the wall element to another element of the construction system, as explained in further detail hereinbelow.

Figure 4B:
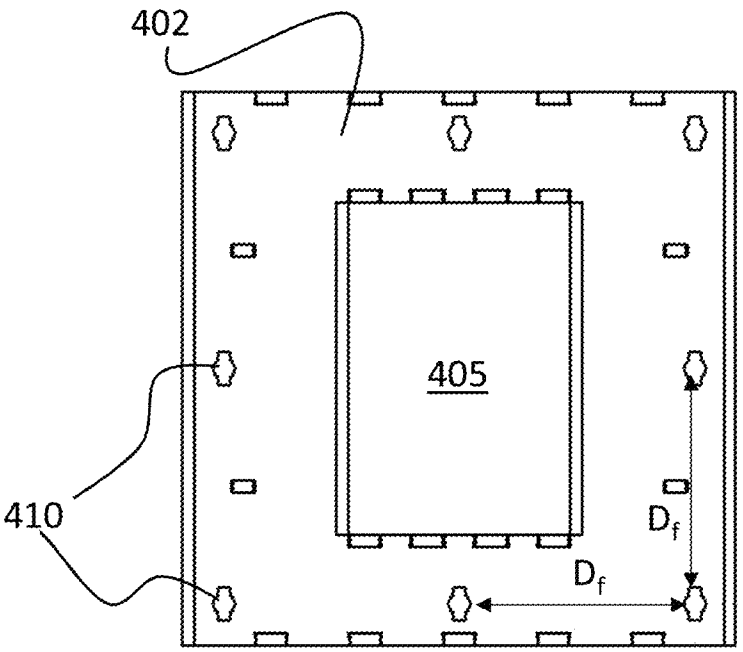
FIGS. 4A, 4B, 4C, 4D, and 4E are, respectively, a perspective view illustration, a planar front view illustration, a planar back view illustration, a planar side view illustration, and a planar top view illustration of a square window element forming part of a modular construction system according to an embodiment of the teachings herein.
Figure 4A:
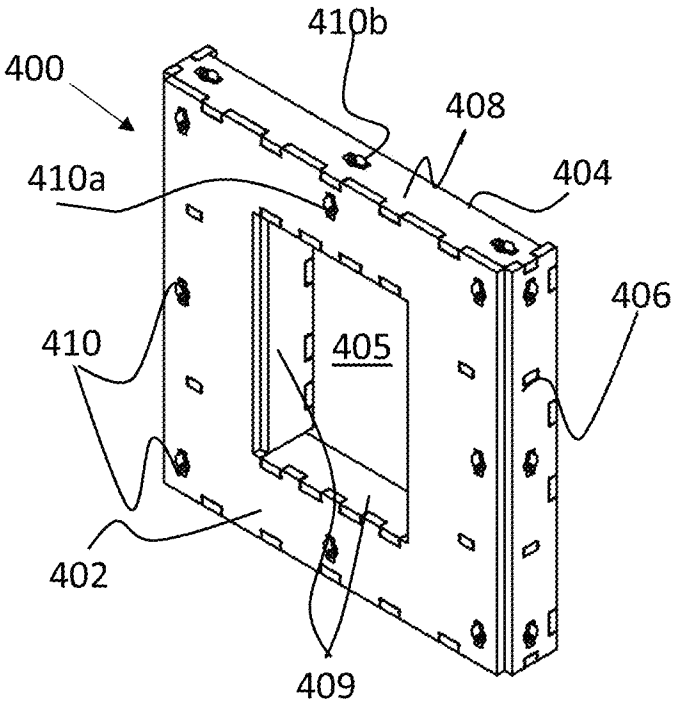
Figure 4D:
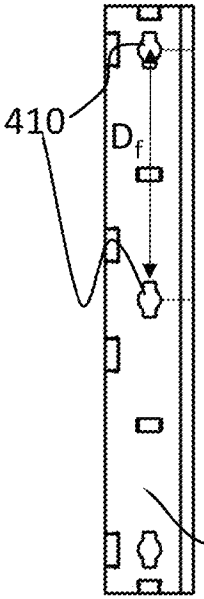
Figure 4E:
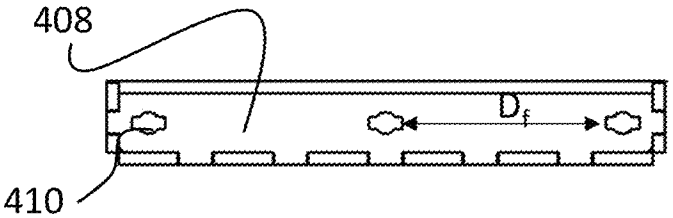
Figure 4C:
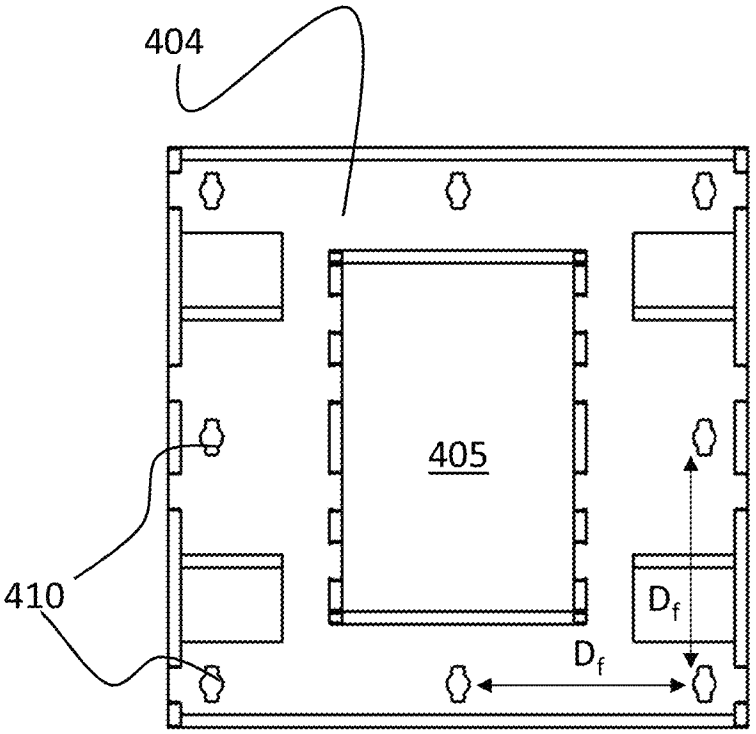

In some embodiments, the width of the side walls and of the top and bottom walls is significantly smaller than the length and width of the front and back walls, such that the element 400 forms a narrow "box", as seen in FIG. 4A.

In some embodiments, square window element 400 is manufactured as the hollow three-dimensional construct illustrated in FIG. 4A. In such embodiments, the user is not required to construct, or form any connections, between any of the walls of the square window element 400.

In other embodiments, square window element 400 is manufactured as a unitary spread planar element which is a spread of all the walls of element 400. In such embodiments, hinges are provided along the connection points between two walls, for example at the connection point between the length of a side wall 406 and the length of front wall 402. In such embodiments, prior to use, the spread planar element is folded, and suitable edges thereof are connected to one another to form the square window element of FIG. 4A, either at the factory or by the user.

In yet other embodiments, square window element 400 is manufactured as multiple planar portions, for example as ten planar portions each comprising one of the walls of square window element 400. In such embodiments, edges of the multiple planar portions are connected to one another to form the square window element of FIG. 4A, prior to use, either at the factory or by the user.

In the embodiment which require connection of walls of the square window element 400 to each other after manufacturing thereof, such as the second and third embodiments provided herein, the walls may be connected to each other using any suitable means, such as snap fit engagement, adhering, soldering, using mechanical fasteners, and the like.

In some embodiments, the thickness of each wall of square window element 400 is in the range of 10 mm-60 mm, or in the range of 25 mm to 45 mm.

In some embodiments, the dimensions of square window element 400 are 1000 mm height and width, and 150 mm thickness, with the window dimensions being 400 mm by 600 mm. However, any other dimensions, suitable for life-size use, are considered within the scope of the present invention.

In some embodiments, square window element 400 is formed of, or includes, one or more metals.

In some embodiments, square window element 400 is formed of, or includes, a cardboard and/or paperboard material.

In some embodiments, square window element 400 is formed of, or includes, a wood based material.

In some embodiments, square window element 400 is formed of, or includes, a plastic material.

In some embodiments, square window element 400 is formed of, or includes, a polymeric material, such as polyethylene, polyolefin, and the like. The polymeric material may be a foamed polymeric material, a cross-linked polymeric material, and the like.

In some embodiments, square window element 400 may be formed of a multi-layer material, or may comprise multiple layers of different materials. For example, square window element 400 may be formed of a multi-layer polymeric material, e.g. as described in US Patent Application Publication No. 2018/0345642, filed Jan. 17, 2017, which is incorporated herein by reference as if fully set forth herein.

In some embodiments, all the walls of square window element 400 are formed of a single material, whereas in other embodiments different walls of a single square window element 400 may be formed of different materials.

It is appreciated that although FIGS. 4A to 4E illustrate a window element wherein the window is centered in the front and back walls, the scope of the present invention includes also an element including a door, which is equivalent to a window element in which the window opening 405 extends all the way to the bottom wall.

It is appreciated that although the illustrated window element is a square window element, i.e. a square wall element having a window formed therein, such a window may be equivalently formed in a rectangular wall element, such as that illustrated in FIGS. 2A to 2E.

FIGS. 5A, 5B, 5C, and 5D are, respectively, a perspective view illustration, a planar front view illustration, a planar side view illustration, and a planar top view illustration of a beam element forming part of a modular construction system according to an embodiment of the teachings herein.

As seen in FIGS. 5A to 5D, the beam element 500 is a three dimensional structure, having front and back walls 502, side (end) walls 506, and top and bottom walls 508. The front and back walls 502 are substantially mirror images of one another, the two side walls 506 are substantially mirror images of one another, and the top and bottom walls 508 are substantially mirror images of one another.

Each of the front, back, top, and bottom walls of beam element 500 includes a plurality of connector-receiving bores 510, equivalent to bores 150 of FIG. 1D, whereas side walls 506 each include a single connector-receiving bore 510. As seen, in the top and bottom walls of beam element 500, the longitudinal axes of the bores 510 coincide with, or are parallel to, the longitudinal axis of the wall. By contrast, the longitudinal axes of bores 510 in front and back walls 502 are perpendicular to the longitudinal axis of the wall. All the bores 510 in each wall of beam element 500 are oriented in the same direction, while the bores 510 in two perpendicular walls may be oriented in opposing directions—see for example bore 510*a* in front wall 502 and bore 510*b* in top wall 508.

The distances between the bores, and the exact positioning of the bores, may be selected as suitable for the specific application. However, in some embodiments, it is desirable that the distances between the bores be fixed, or at least the distances between some of the bores be fixed, to facilitate easier connection between elements of different dimensions, as explained in further detail hereinbelow.

For example, in the illustrated embodiment, all the bores on the top, bottom, front, and back walls of beam element 500 are disposed at the same distance from each other, the distance being labeled as Df. In some embodiments, the distance Df of beam element 500 is equal to the distance Df of rectangular wall element 200 (FIGS. 2A to 2E) to facilitate connection of different types of walls to each other, as explained in further detail hereinbelow.

In some embodiments, the distance Df is in the range of 350 mm to 500 mm, or in the range of 400 mm to 450 mm. In some embodiments, the distance Df is 425 mm.

Figure 5B:
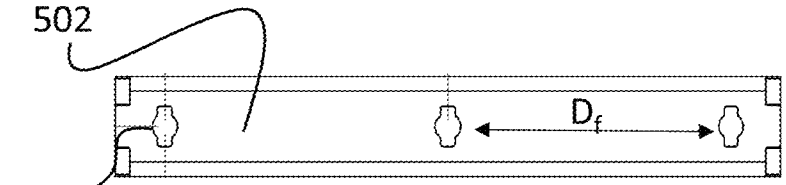
FIGS. 5A, 5B, 5C, and 5D are, respectively, a perspective view illustration, a planar front view illustration, a planar side view illustration, and a planar top view illustration of a beam element forming part of a modular construction system according to an embodiment of the teachings herein.
Figure 5D:
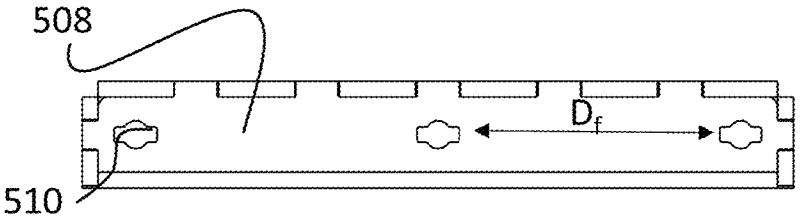
Figure 5A:
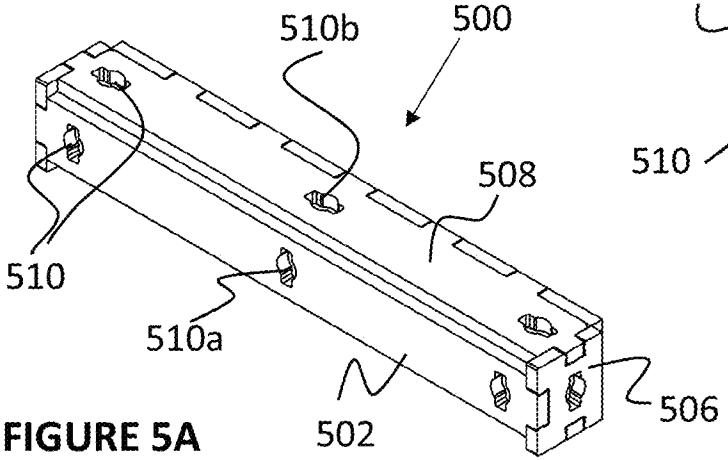
Figure 5C:
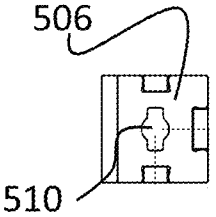

In some embodiments, the width of the walls of beam element 500 significantly smaller than the width of the front, back, top, and bottom walls, such that the element 500 forms a narrow "box", as seen in FIG. 5A.

In some embodiments, beam element 500 is manufactured as the hollow three-dimensional construct illustrated in FIG. 5A. In such embodiments, the user is not required to construct, or form any connections, between any of the walls of the beam element 500.

In other embodiments, beam element 500 is manufactured as a unitary spread planar element which is a spread of all the walls of element 500. In such embodiments, hinges are provided along the connection points between two walls, for example at the connection point between the length of a side wall 506 and the length of front wall 502. In such embodiments, prior to use, the spread planar element is folded, and suitable edges thereof are connected to one another to form the beam element of FIG. 5A, either at the factory or by the user.

In yet other embodiments, beam element 500 is manufactured as multiple planar portions, for example as six planar portions each comprising one of the walls of beam element 500. In such embodiments, edges of the multiple planar portions are connected to one another to form the beam element of FIG. 5A, prior to use, either at the factory or by the user.

In the embodiment which require connection of walls of the beam element 500 to each other after manufacturing thereof, such as the second and third embodiments provided herein, the walls may be connected to each other using any suitable means, such as snap fit engagement, adhering, soldering, using mechanical fasteners, and the like.

In some embodiments, the thickness of each wall of beam element 500 is in the range of 10 mm-60 mm, or in the range of 25 mm to 45 mm.

In some embodiments, beam element 500 is formed of, or includes, one or more metals.

In some embodiments, beam element 500 is formed of, or includes, a cardboard and/or paperboard material.

In some embodiments, beam element 500 is formed of, or includes, a wood based material.

In some embodiments, beam element 500 is formed of, or includes, a plastic material.

In some embodiments, beam element 500 is formed of, or includes, a polymeric material, such as polyethylene, polyolefin, and the like. The polymeric material may be a foamed polymeric material, a cross-linked polymeric material, and the like.

In some embodiments, beam element 500 may be formed of a multi-layer material, or may comprise multiple layers of different materials. For example, beam element 500 may be formed of a multi-layer polymeric material, e.g. as described in US Patent Application Publication No. 2018/0345642, filed Jan. 17, 2017, which is incorporated herein by reference as if fully set forth herein.

In some embodiments, all the walls of rectangular wall element 500 are formed of a single material, whereas in other embodiments different walls of a single rectangular wall element 500 may be formed of different materials.

It will be appreciated by people of skill in the art that although specific structural elements have been described and illustrated will respect to FIGS. 2A to 5D, many other types of structural elements may be formed, which would be connectable by the connector of FIGS. 1A to 1C. In fact, any element including a wall portion having at least one bore as described with respect to FIG. 1D, is defined as a structural element with respect to the teachings herein.

It will further be appreciated that although all the structural elements described hereinabove with respect to FIGS. 2A to 5B include only planar walls, some structural elements forming part of the system of the teachings herein may include arcuate walls, such as for example an arched window element which may have an arched wall surrounding the window, or a fully arched element, for example suitable for forming a tunnel, may have two or more arched wall portions.

Reference is now made to FIGS. 6A, 6B, 6C, and 6D, which are, respectively, a perspective view illustration, a planar top view illustration, a planar front view illustration, and a planar side view illustration of an exemplary three-dimensional structure 600 formed of the modular construction system according to an embodiment of the teachings herein.

As seen in FIGS. 6A to 6D, structure 600 is formed of four rectangular wall elements 602, 604, 606, and 608, each equivalent to rectangular wall element 200 described hereinabove with respect to FIGS. 2A to 2E. Structure 600 is formed as an L-shape, as seen clearly in FIG. 6D, wherein rectangular wall element 602 forms the short edge of the of L-shape, and rectangular wall elements 604, 606, and 608 form the longer edge.

As seen, rectangular wall elements 602, 604, and 606 are arranged such that their longitudinal axes are parallel to each other, and are perpendicular to the ground, and rectangular wall element 608 is arranged such that the longitudinal axis thereof is parallel to the ground, and perpendicular to the longitudinal axes of wall elements 602, 604, and 606. More specifically, a side wall of rectangular wall element 602 is connected to the back wall of rectangular wall element 604, side walls of rectangular wall elements 604 and 606 are connected to each other, and a top wall of rectangular wall element 608 is connected to the opposing side wall of wall element 606. This arrangement is facilitated by the use of fixed distances between the connector-receiving bores in all sides of each wall element, such that the connector-receiving bores of wall element 608 align with those of wall element 606, even though the orientation of the two wall elements is different.

Figure 6A:
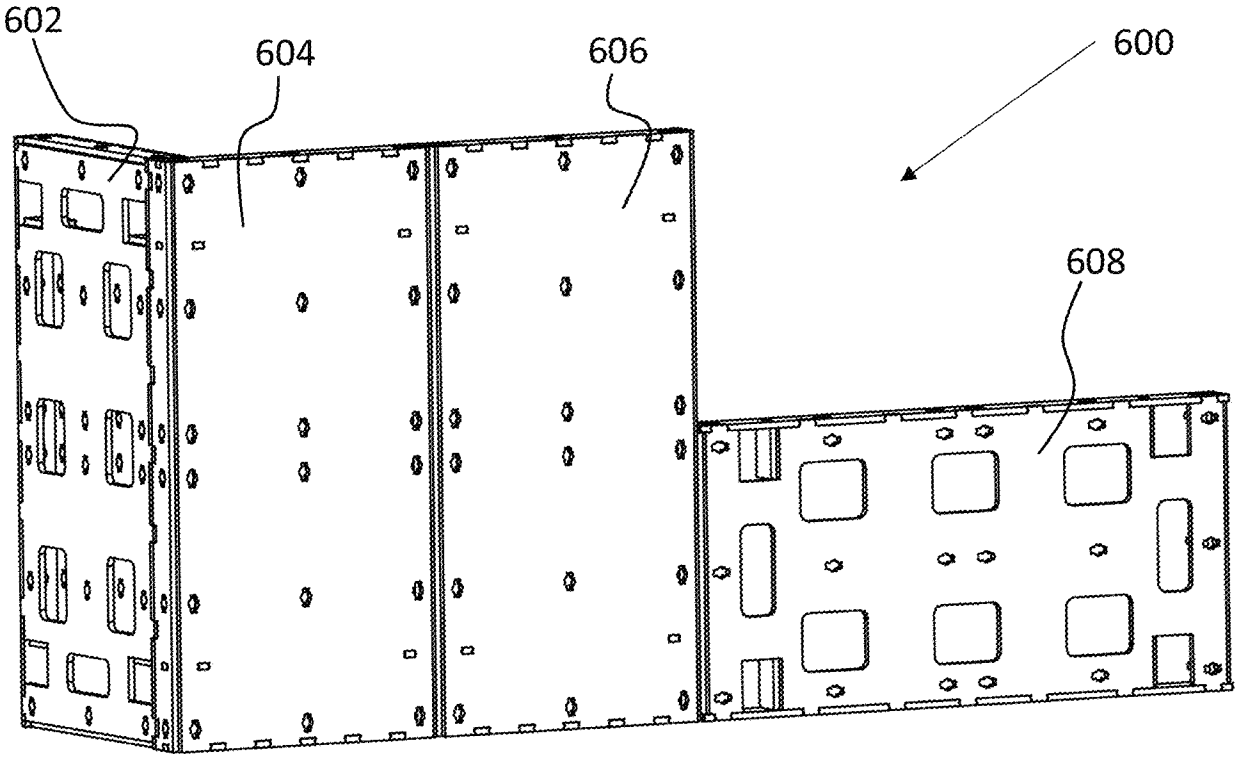
FIGS. 6A, 6B, 6C, and 6D are, respectively, a perspective view illustration, a planar top view illustration, a planar front view illustration, and a planar side view illustration of an exemplary three-dimensional structure formed of the modular construction system according to an embodiment of the teachings herein using the rectangular wall elements of FIGS. 2A to 2E.
Figures 6B, 6C, 6D:
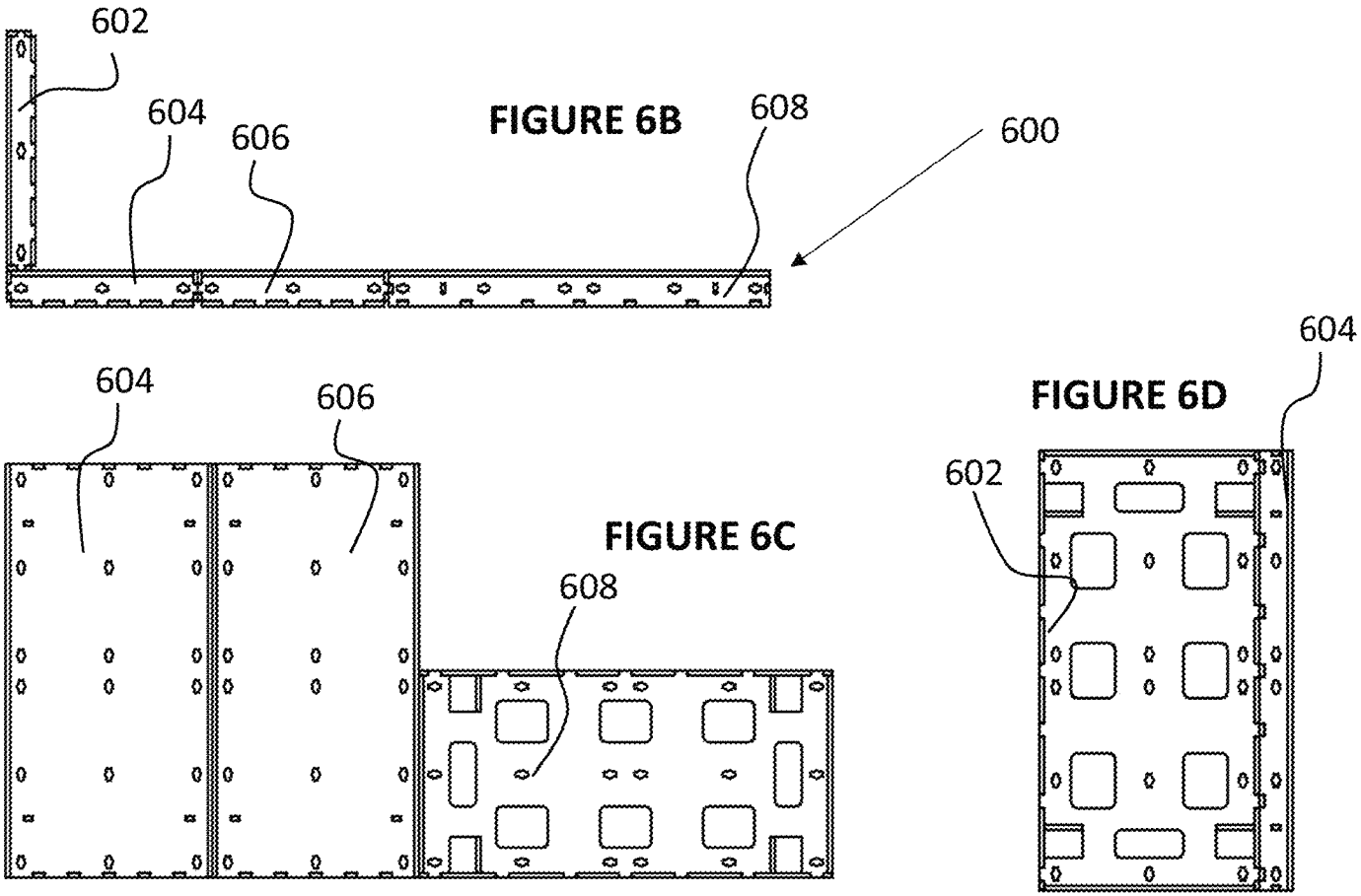

As seen in FIG. 6A, rectangular wall elements 602 and 608 are arranged such that the front wall thereof faces the interior of the L-shaped structure 600, whereas rectangular wall elements 604 and 606 are arranged such that the back walls thereof face the interior of the L-shaped structure. It is appreciated that this arrangement is selected as convenient for this specific structure, while other arrangements of the front/back orientation of the rectangular wall elements are equally possible, depending on the requirements of the structure being built.

It will be appreciated by people of skill in the art that although the three dimensional structure 600 of FIGS. 6A to 6D is formed of four identical wall elements, one may similarly form a three dimensional structure including wall elements of different types. For example, rectangular wall element 608 may be replaced by a square wall element (FIGS. 3A to 3E). As another example, one of wall elements 602, 604, or 606 may be replaced by a door element or by a combination of a square wall element (FIGS. 3A to 3E) and a square window element (FIGS. 4A to 4E). As yet another example, a beam element (FIGS. 5A to 5D) may be placed between side walls of wall elements 604 and 606, for example at a top end thereof, to form an entry archway.

As seen, multiple connectors may be used to connect large structural elements to each other. This is a particular feature of the present invention, in which the connectors are separate and distinct from the structural elements being connected.

Furthermore, some of the structural elements used to form three dimensional structures according to the teachings herein may include at least one non-planar (e.g. curved) wall, such as, for example, arched structural elements for forming an arched walkway or tunnel, or elements having an arched window, as described in further detail hereinbelow. It will further be appreciated that L-shaped structure 600 is merely one example of a type of three dimensional structure that may be built using the modular construction system of the present invention. The construction elements described herein may be used to build any number of different types of structures, including very tall structures and multi-story structures, as desired by the user.

As discussed hereinabove, each of the structural elements used to form three-dimensional structures using the inventive modular construction system comprises light and durable materials. As such, in some embodiments, structures built using the inventive modular construction system can remain standing, in mild weather conditions, for at least a week, at least a month, at least six months, at least a year, or even several years.

Figure 7A:
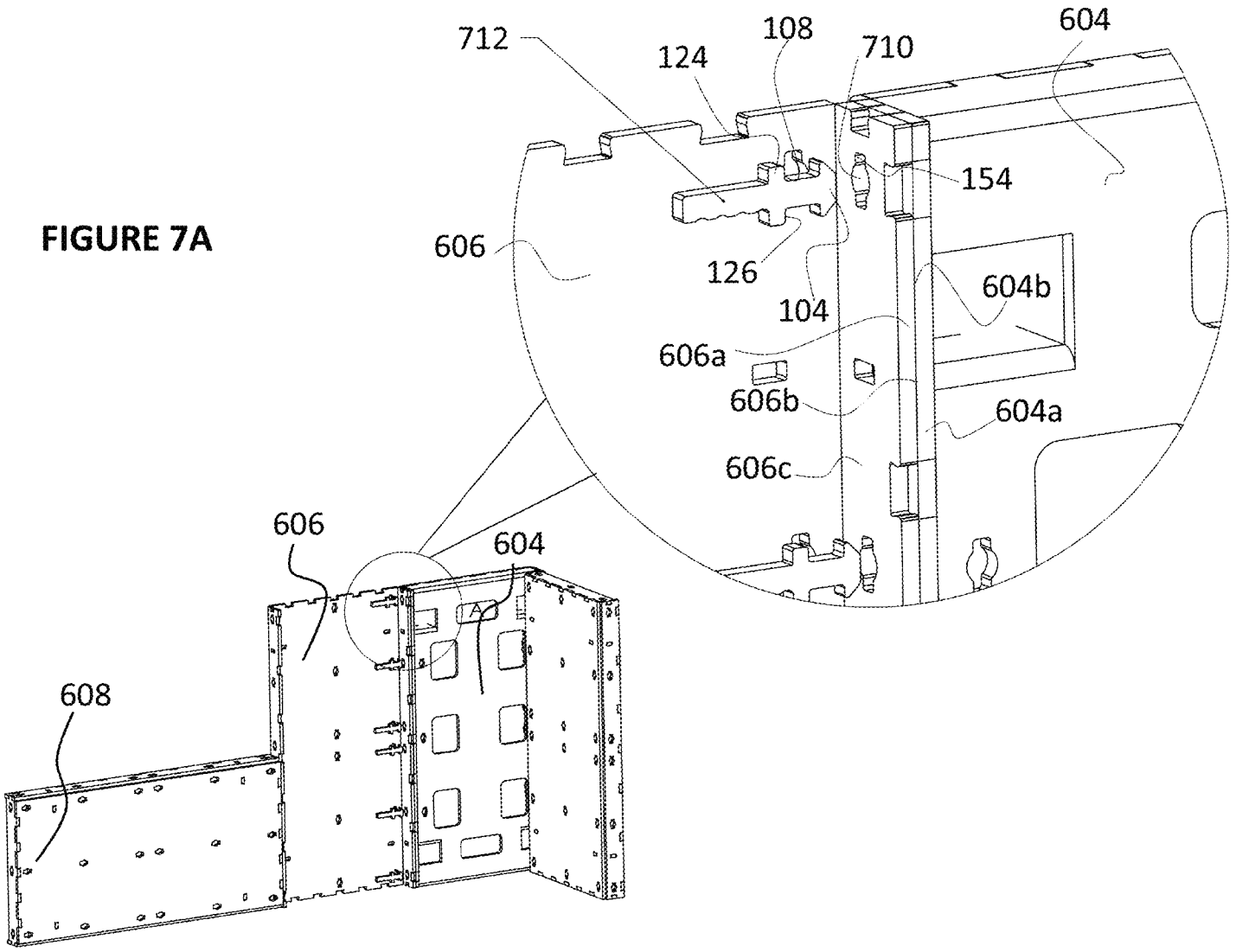
FIGS. 7A, 7B, and 7C are, respectively, illustrations of steps of insertion and locking of the connectors of FIGS. 1A to 1C in the structure of FIGS. 6A to 6D, according to an embodiment of the teachings herein.
Figure 7B:
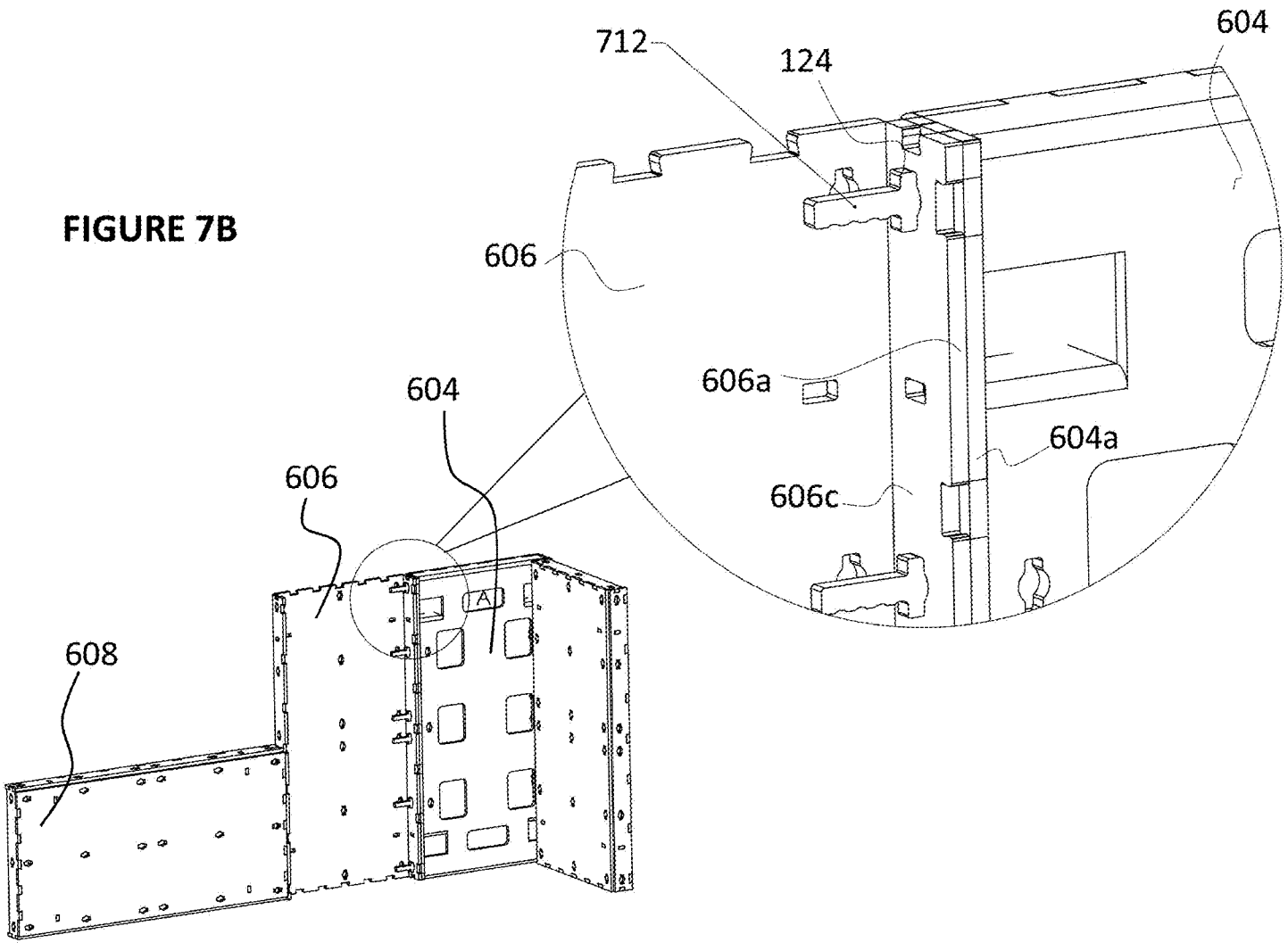
Figure 7C:
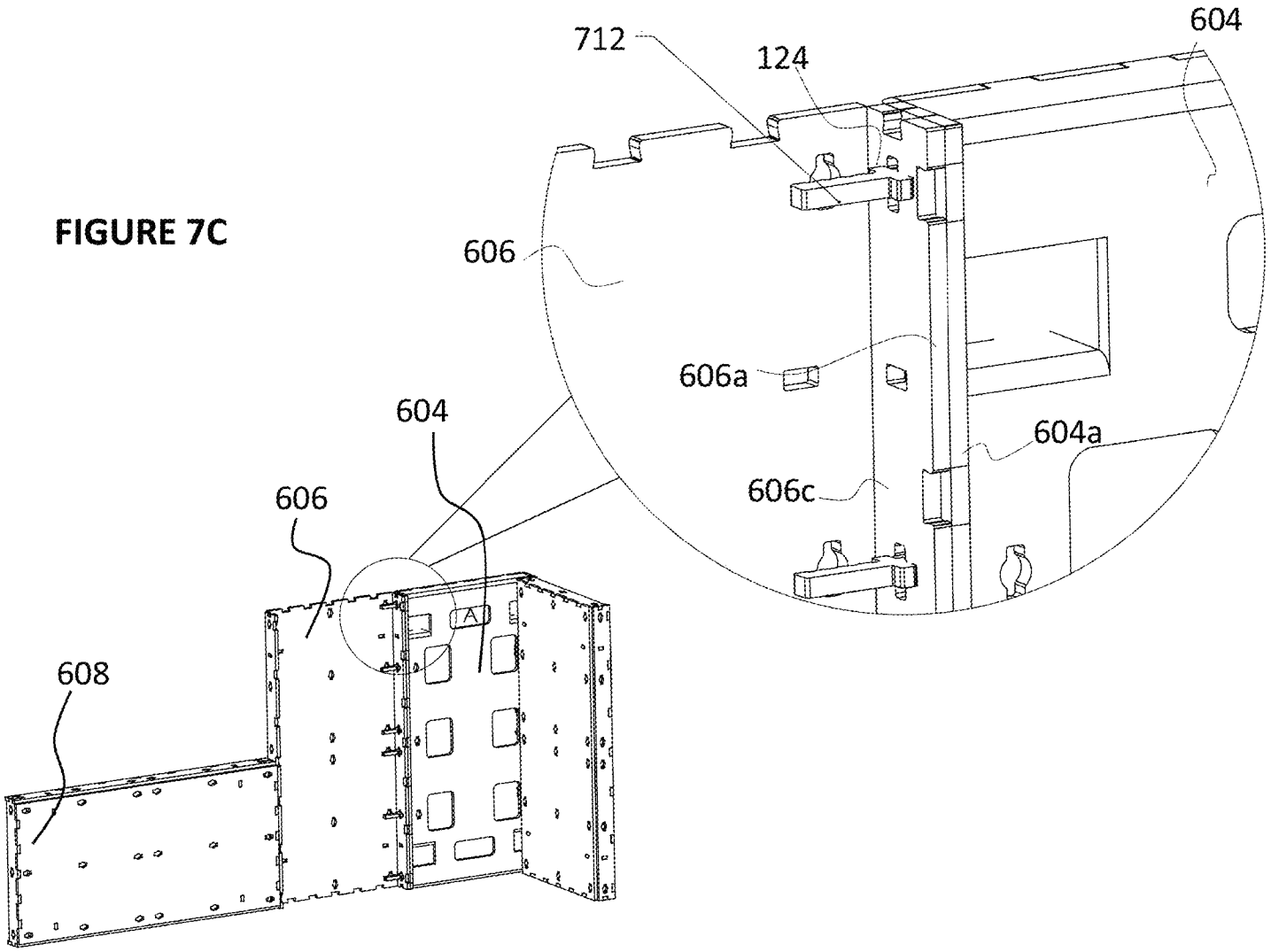

Reference is now made to FIGS. 7A, 7B, and 7C, which are, respectively, illustrations of steps of insertion and locking of connectors 100 of FIGS. 1A to 1C in three-dimensional structure 600 of FIGS. 6A to 6D to connect components thereof, according to an embodiment of the teachings herein.

FIGS. 7A to 7C illustrates steps of inserting connectors 100 connecting side walls of rectangular wall elements 604 and 606 of FIGS. 6A to 6D. It will be appreciate however, that the process illustrated in FIGS. 7A to 7C is suitable for connection of any two constructions elements of the inventive system, such as elements described hereinabove and other elements not explicitly shown.

In the illustrated embodiments, the rectangular wall elements 604 and 606 have been partially cut away to more clearly show the location and operation of the connectors. For clarity, the side walls being connected are labeled 604*a*, and 606*a*, respectively. Surfaces 604*b* and 606*b* of side walls 604*a* and 606*a* are in engagement with each other, whereas opposing surfaces 604*c* and 606*c* are distal to the engagement point between side walls 604*a* and 606*a*.

As seen in FIG. 7A, at an initial stage, connector-receiving bores 710 of the two elements to be connected are aligned with each other. A connector 712 is aligned along side each pair of aligned connector-receiving bores 710 with the head portion 104 of the connector facing toward, and being adjacent to, one of the aligned connector-receiving bores 710. Additionally, the connector 712 is oriented such that the width of the connector is aligned with the longitudinal length of the bore, such that the head portion 104 of the connector, including end surface 106 and the base surface 108 (see also FIGS. 1A to 1C) is in position to pass through the indentations 154 (see also FIG. 1D) of the aligned connector-receiving bores 710. In this arrangement, the longitudinal axis of the connector 712 is perpendicular to the longitudinal axes of the aligned connector-receiving bores 710, and a transverse axis extending along the width of the connector is parallel with the longitudinal axes of the aligned connector-receiving bores 710. Furthermore, the longitudinal axis of connector 712 is perpendicular to surfaces 604*c* and 606*c* of side walls 604*a* and 606*a*.

Turning to FIG. 7B, it is seen that at a second connection step the previously aligned connector 712 is partially inserted into the aligned connector-receiving bores 710. In this orientation, the transversely extending protrusions 124 (see also FIGS. 1A to 1C) of the connector 712 remain outside of the bores 710. The segment of the longitudinal body portion 102 (see also FIGS. 1A to 1C) connecting the head portion 104 and the transversely extending protrusions 124, is disposed within the bores, and head portion 104 has extended through the bores and is disposed on the opposing side thereof, as explained in further detail hereinbelow with respect to FIGS. 8A and 8B.

Turning now to FIG. 7C, it is seen that at a third and final connection, or locking, step, the connector 712 is rotated within the aligned connector-receiving bores 710. As such, the width of the connector 712 (for example between protrusions 124, FIGS. 1A to 1C) is perpendicular to the longitudinal axis of the bores 710.

Figure 8A:
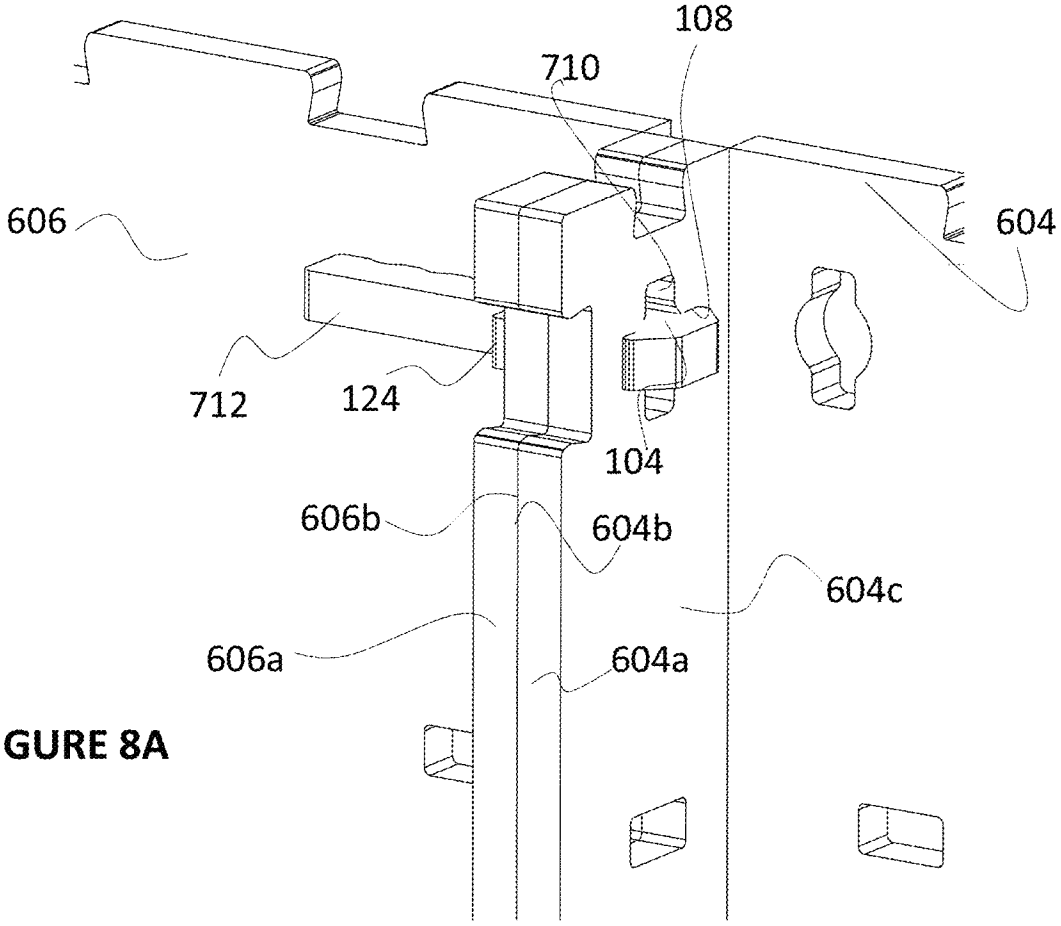
FIGS. 8A and 8B are, respectively, a perspective view illustration and a top view planar illustration of a locked connector between two structural elements according to an embodiment of the teachings herein.
Figure 8B:
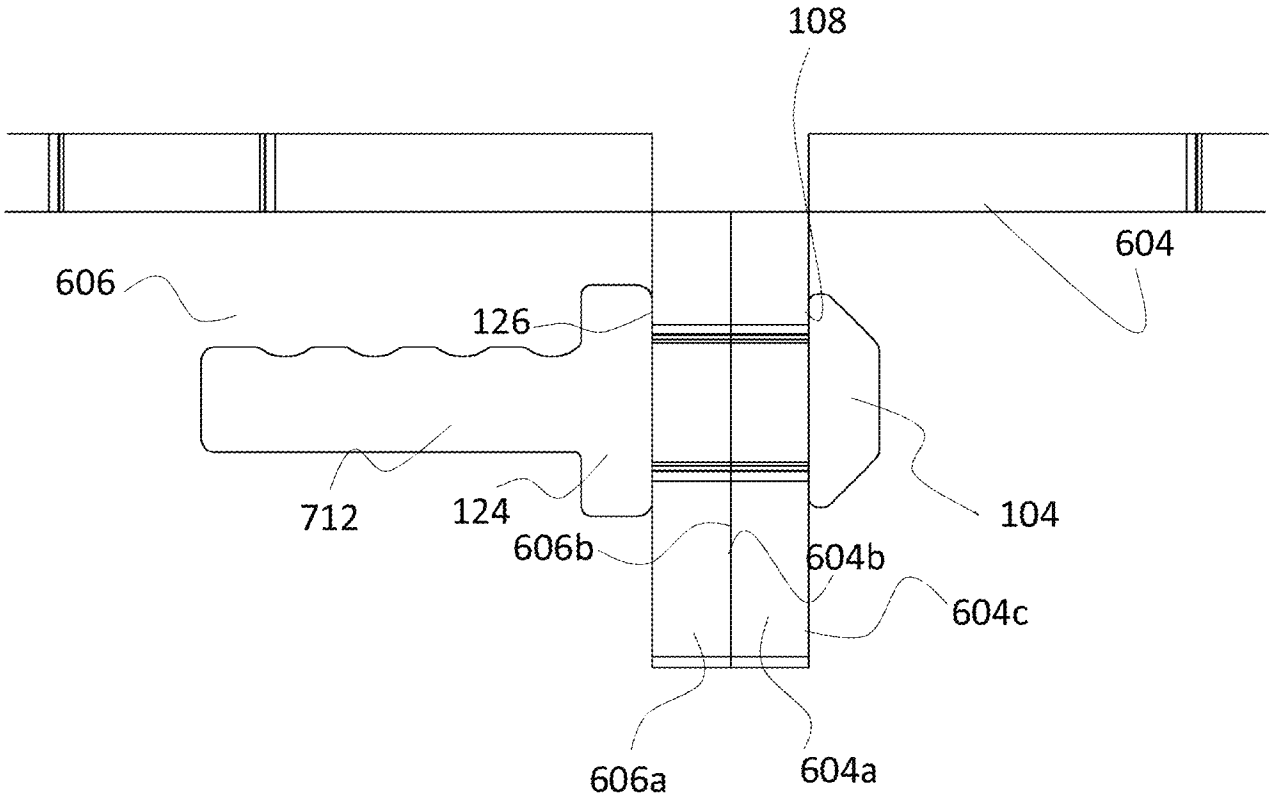

Reference is now additionally made to FIGS. 8A and 8B, which are, respectively, a perspective view illustration and a top view planar illustration of a locked connector connecting walls of two structural elements according to an embodiment of the teachings herein. For clarity, the reference numerals used in FIGS. 8A and 8B correspond to those used in FIGS. 7A to 7C. However, the teachings provided herein with respect to FIGS. 8A and 8B are equally applicable for connection of any two structural elements of the inventive construction system.

As seen, in FIGS. 8A and 8B, the connector 712 had been inserted into aligned connector-receiving bores 710 in the direction extending from wall 606*a* to wall 604*a*, which, in the illustrated embodiment, is from left to right. The head portion 104 of connector 712 has extended fully through bores 710, and, following rotation of the connector 712, is arranged such that base surface 108 thereof is adjacent to, and in some embodiments engages, side wall surface 604*c*, distal to the engagement point between side walls 604*a* and 606*a*. As seen clearly in FIGS. 7C and 8B, in the locked position, first surface 126 of protrusions 124 of the connector 712 is adjacent to, and in some embodiments engages, side wall surface 606*c* distal to the engagement point between side walls 604*a* and 606*a*. The segment of longitudinal body portion 102 of connector 710 disposed between protrusions 124 and head portion 104 remains disposed within the aligned connector-receiving bores 710.

As mentioned hereinabove with respect to FIGS. 1A to 1C, the length of the segment disposed within aligned bores 710, labeled in FIGS. 1A to 1C as D1, is selected to be equal to the sum of the widths of side walls 604*a* and 606*a*, or just slightly larger. As such, in the locked position, the side walls 604*a* and 606*a* engage each other as well as surfaces of the connector 712, as described above, and have no degree of freedom in the direction of the longitudinal axis of the connector. However, in some embodiments, it may be beneficial to make the distance D1 larger than the sum of the widths of side walls 604*a* and 606*a*, to reduce the force required when rotating the connector 712 into the locked position.

It will be appreciated by people of skill in the art that disconnection of two structural elements of the inventive system may be accomplished by reversing the steps illustrated in FIGS. 7A to 7C.

Figure 9A:
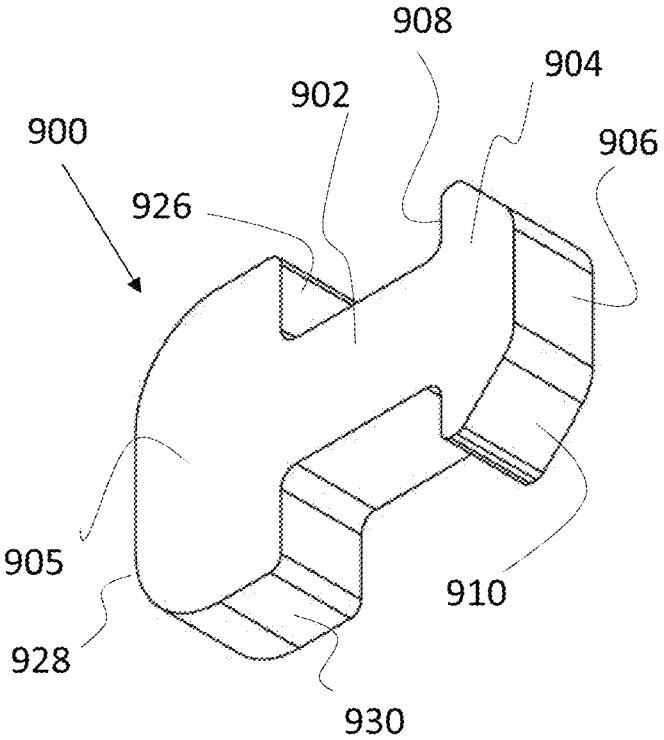
FIGS. 9A, 9B, and 9C are, respectively, a perspective view illustration, a planar front view illustration, and a planar side view illustration of a second embodiment of a connector forming part of a modular construction system according to the teachings herein.
Figure 9B:
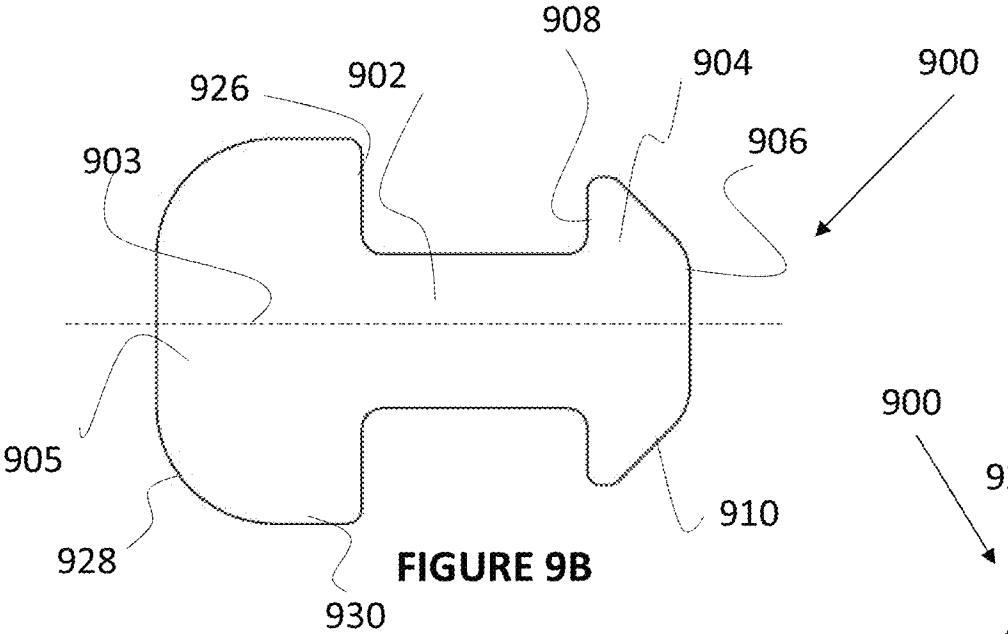
Figure 9C:
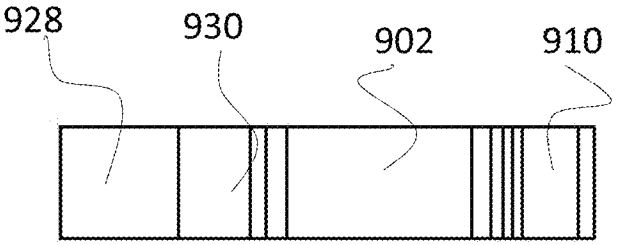

Reference is now made to FIGS. 9A, 9B, and 9C, which are, respectively, a perspective view illustration, a planar front view illustration, and a planar side view illustration of a connector 900 forming part of a modular construction system according to another embodiment of the teachings herein.

As seen, connector 900 includes a longitudinal body portion 902 arranged along a longitudinal axis 903. Longitudinal body portion 902 terminates at one end in a head portion 904, and at an opposing end in a gripping portion 905.

As seen, head portion 904 includes an end surface 906, a base surface 908, and slanted side surfaces 910 substantially as described hereinabove with respect to FIGS. 1A to 1C. Base surface 908 extends outwardly from sides of longitudinal body portion 902, substantially perpendicularly thereto.

Gripping portion 905 includes a first surface 926, facing toward base surface 908 of head portion 904, and a second arcuate surface 928 facing away from base surface 908. Side surface 930 connect ends of surfaces 926 and 928. Typically, surface 926 is substantially perpendicular to side surfaces of longitudinal body portion 902, and is substantially parallel to base surface 908.

As described hereinabove with respect to FIGS. 1A to 1C, the widths of base surface 908 and of first surface 926 are greater than the width of the longitudinal body portion 902. In some embodiments, such as the illustrated embodiment, first surface 926 has a greater width than base surface 908, as described hereinabove with respect to FIGS. 1A to 1C.

As described hereinabove, the distance between base surface 908 and first surface 926 is substantially equal to twice a width of wall portions of elements of the modular construction system.

The thickness of connector 900, as well as the material(s) from which it is formed, or which it includes, may be described hereinabove with respect to FIGS. 1A to 1C.

Figure 10A:
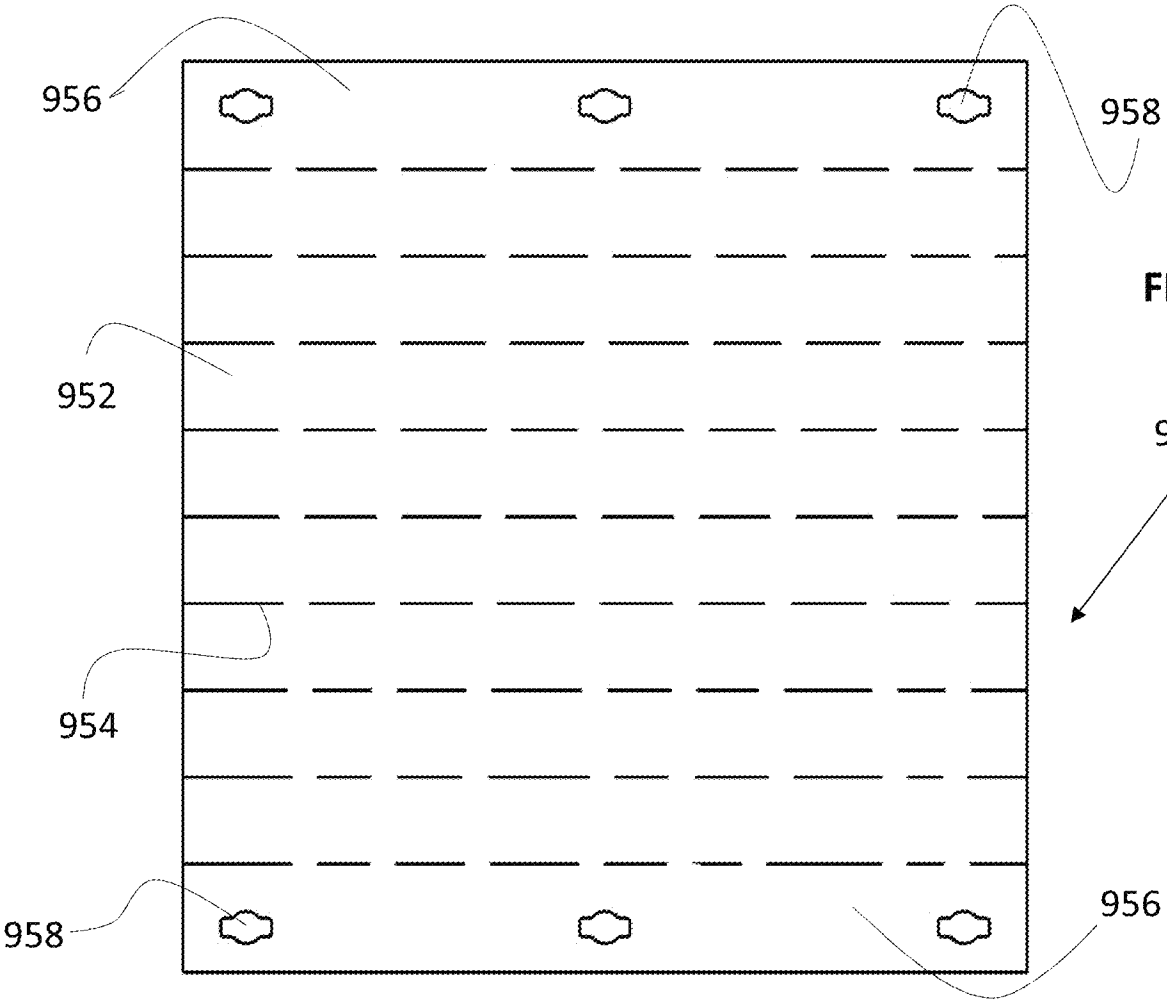
FIGS. 10A, 10B, and 10C are, respectively, a spread illustration, a perspective view illustration, and a planar side view illustration of an arch element forming part of a modular construction system according to an embodiment of the teachings herein.
Figure 10B:
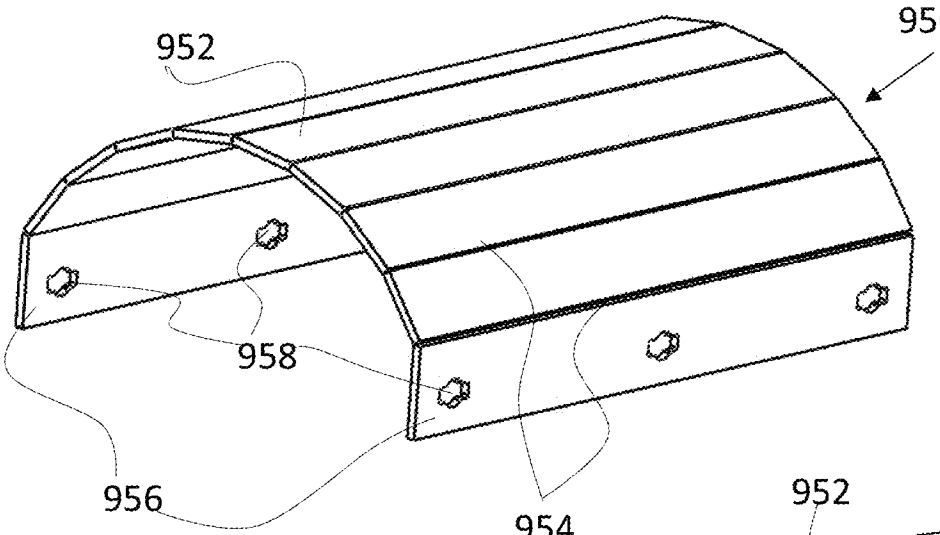
Figure 10C:
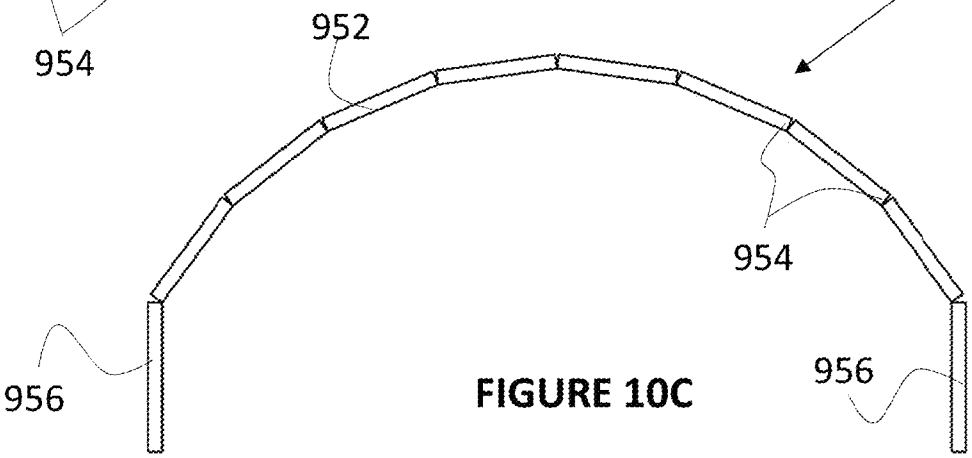

Reference is now made to FIGS. 10A, 10B, and 10C, which are, respectively, a spread illustration, a perspective view illustration, and a planar side view illustration of an arch element 950 forming part of a modular construction system according to an embodiment of the teachings herein.

As seen, arch element 950 includes a generally planar rectangular body 952 having multiple longitudinal slot lines 954 disposed therealong. Each slot line 954 extends only partially through the thickness of body 952, enabling arch element 950 to be arched. In the illustrated embodiment, slot lines 954 are equidistant. However, other arrangements of the slot lines 954 are considered within the scope of the present invention. A pair of connection elements 956 are disposed at each longitudinal edge of rectangular body 952. Each of connection elements 956 includes a plurality of connector receiving bores 958, similar to the bore shown in FIG. 1D. Longitudinal axes of bores 958 are disposed along, or parallel to, a longitudinal axis of connection elements 956 and of rectangular body 952. In some embodiments, rectangular body 952 and connection elements 956 may be unitarily formed, such as from a single sheet of material.

Typically, when the arch element 950 is in the arched configuration shown in FIGS. 10B and 10C, connection elements 956 are substantially parallel to each other, and may be substantially vertical relative to a base surface. In some embodiments, arch element 950 may be used as an upper element of a structure, such as a top of a tunnel, as illustrated for example in FIGS. 12A to 12E. Distances between bores 958 may be selected to match distances in other elements of the system, as described hereinabove.

The dimensions of arch element 950 may be dependent on an application in which it is used. For example, in some embodiments, a longitudinal length of the arch element may be equal to a length of a tunnel to be covered, and a transverse width of the arch element, in the planar and arched orientations, may be dependent on the desired width of the resulting structure, such as tunnel. In some embodiments, the thickness of the rectangular body is in the range of 10 mm to 15 mm, and in some embodiments is 12 mm.

In some embodiments, arch element 950 may have a non-rectangular contour. For example in some embodiments in which the arch element 950 is used as a cover of an intersecting tunnel, multiple such arch elements would have to meet to form a tunnel intersection cover. In some embodiments, a tunnel intersection cover can be formed from arched male-type elements and arched female-type elements, but any other arrangement forming covers for an intersection of tunnels is considered within the scope of the present invention.

Reference is now made to FIGS. 11A, 11B, 11C, and 11D, which are illustrations of reinforcing elements forming part of a modular construction system according to an embodiment of the teachings herein.

Figure 11A:
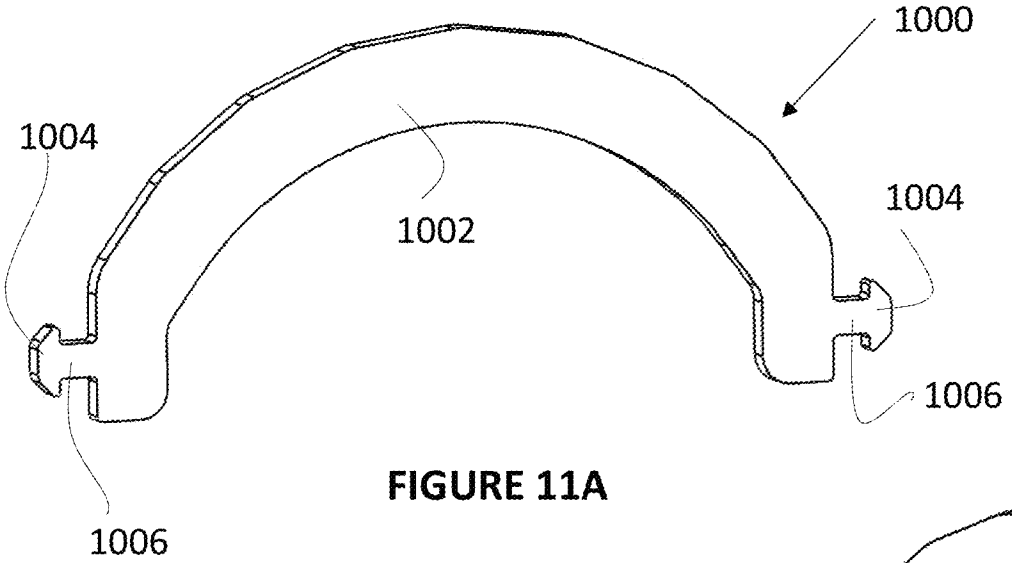
FIGS. 11A, 11B, 11C, and 11D are illustrations of reinforcing elements forming part of a modular construction system according to an embodiment of the teachings herein.

FIG. 11A shows a lower arch-reinforcing element 1000, which includes an arched body portion 1002. A pair of engagement protrusions 1004, each similar to head portion 104 of FIGS. 1A to 1C, are connected to arched body portion 1002 via corresponding neck portions 1006.

In use, the lower arch-reinforcing element 1000 is connected to an arch element (as shown in FIGS. 10A to 10C) and to another element, on each of its opposing sides. Thus, the arch element leans on the arch-reinforcing element, and the contour of the arch element is determined, or supported, by the arch reinforcing element, as shown for example in the structure of FIGS. 12A to 12E.

In some embodiments, the thickness of the lower arch-reinforcing element 1000 is in the range of 20 mm to 25 mm, and in some embodiments is 22 mm.

Figure 11B:
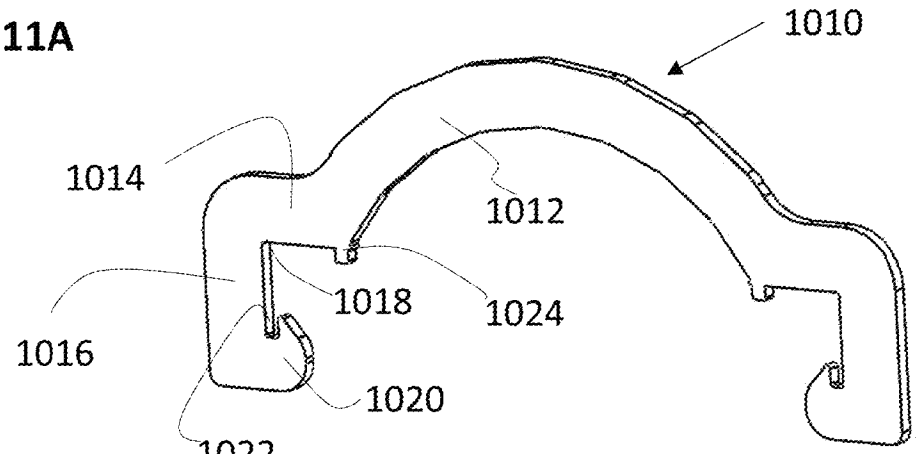

FIG. 11B shows an upper arch-reinforcing element 1010, which includes an arch portion 1012. On each end of arch portion 1012 is disposed a connection portion including a substantially horizontal portion 1014 terminating in a substantially vertical portion 1016, and forming an inner corner 1018. A protrusion 1020 extends inwardly from vertical portion 1016, such that a slot 1022 is formed between vertical portion 1016 and the protrusion 1020. A second protrusion 1024 extends downwardly from horizontal portion 1014, at a corner 1026 of arched portion 1012 and horizontal portion 1014.

As seen in FIGS. 12A to 12E, in use, upper arch-reinforcing element 1010 is used to reinforce a connection between an arch element (as shown in FIGS. 10A to 10C) and two linear elements (for example wall elements, window elements, door elements, or beam elements as shown in FIGS. 2A to 5D) on either side of the arch. Generally speaking, a surface of each of the planar elements is disposed within each slot 1022, and protrusions 1024 fill a gap formed at the corner of each of the linear elements. A lower surface of arched portion 1012 engages an upper surface of the arch element, and determines, or supports, the contour of the arch.

In some embodiments, the thickness of the upper arch-reinforcing element 1010 is in the range of 20 mm to 25 mm, and in some embodiments is 22 mm.

Figure 11D:
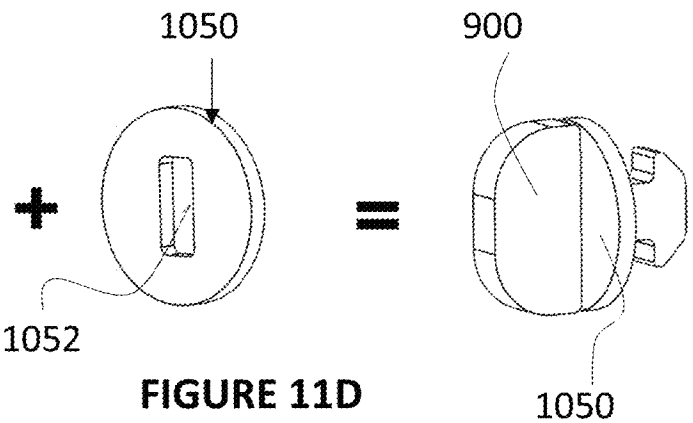
Figure 11C:
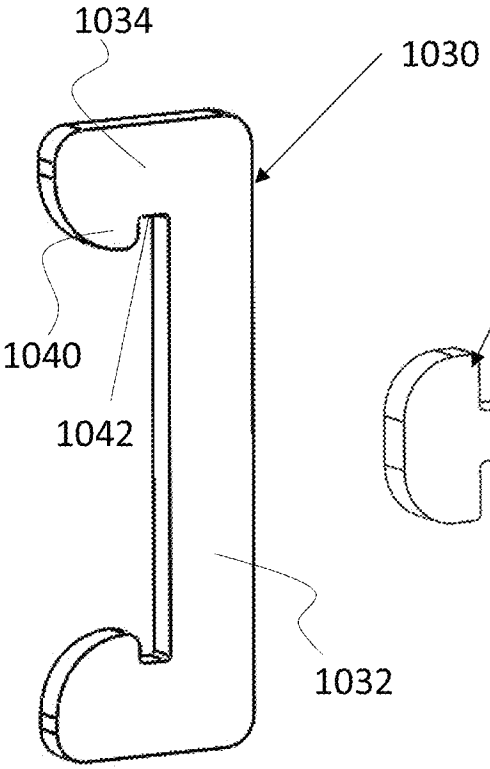

FIG. 11C shows a side-reinforcing element 1030, which includes a longitudinal portion 1032. On each end of longitudinal portion 1032 is disposed a transverse connection portion 1034 terminating in a curved end. A protrusion 1040 extends longitudinally inwardly from transverse connection portion 1034, such that a slot 1042 is formed between longitudinal portion 1032 and the protrusion 1040.

As seen in FIGS. 12A to 12E, in use, side-reinforcing element 1030 is used to reinforce a connection between two linear elements (for example wall elements, window elements, door elements, or beam elements as shown in FIGS. 2A to 5D). Generally speaking, a surface of each of the connected linear elements is disposed within each slot 1042.

In some embodiments, the thickness of the side-reinforcing element 1030 is in the range of 20 mm to 25 mm, and in some embodiments is 22 mm.

FIG. 11D shows a connector-reinforcing element 1050, used in conjunction with a connector 1052, such as the connector of FIGS. 9A to 9C. As seen, the connector-reinforcing element 1050 is a substantially circular element having a generally rectangular slot extending therethrough. Connector-reinforcing element 1050 functions substantially as a washer does when used with a bolt or screw, as shown and described hereinbelow with respect to FIGS. 12A to 12E.

FIGS. 12A, 12B, 12C, 12D, and 12E are, respectively, a perspective view illustration, a planar front view illustration, a planar side view illustration, a sectional illustration, and an enlarged perspective view illustration of a second exemplary three-dimensional structure 1100 formed of the modular construction system according to an embodiment of the teachings herein, using elements of FIGS. 2A to 5E and of FIGS. 10A to 11D.

As seen in FIGS. 12A to 12E, structure 1100 includes two larger rectangular wall elements 1102, each similar to rectangular wall element 200 described hereinabove with respect to FIGS. 2A to 2E, two smaller rectangular wall elements 1104, each similar to half of the larger rectangular wall elements 1102, and an arch element 1106, similar to arch element 950 described hereinabove with respect to FIGS. 10A to 10C.

Larger rectangular wall elements 1102 are arranged such that a longitudinal axis thereof is perpendicular to a base surface, or to the floor, and is also perpendicular to a longitudinal axis of smaller rectangular wall elements 1104. As such, a longer edge of each of smaller rectangular wall elements 1104 is connected, using connectors of the present invention as described hereinabove with respect to FIGS. 7A to 8B, to a shorter edge of a corresponding one of larger rectangular wall elements 1102. As such, each wall of the structure 1100 is formed of a larger rectangular wall element 1102 and of a smaller rectangular wall element 1104.

Figure 12B:
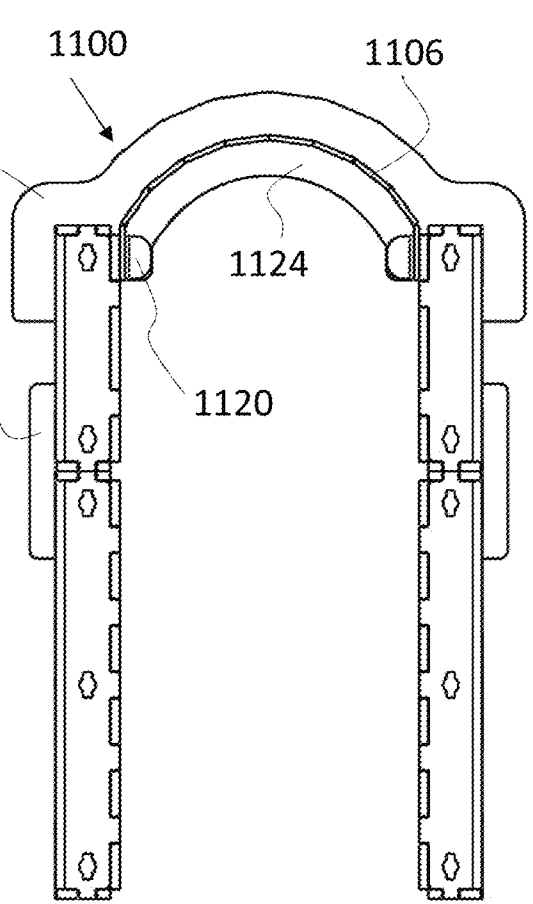
FIGS. 12A, 12B, 12C, 12D, and 12E are, respectively, a perspective view illustration, a planar front view illustration, a planar side view illustration, a sectional illustration, and an enlarged perspective view illustration of a second exemplary three-dimensional structure formed of the modular construction system according to an embodiment of the teachings herein, using elements of FIGS. 2A to 5E and of FIGS. 10A to 11D.
Figure 12A:
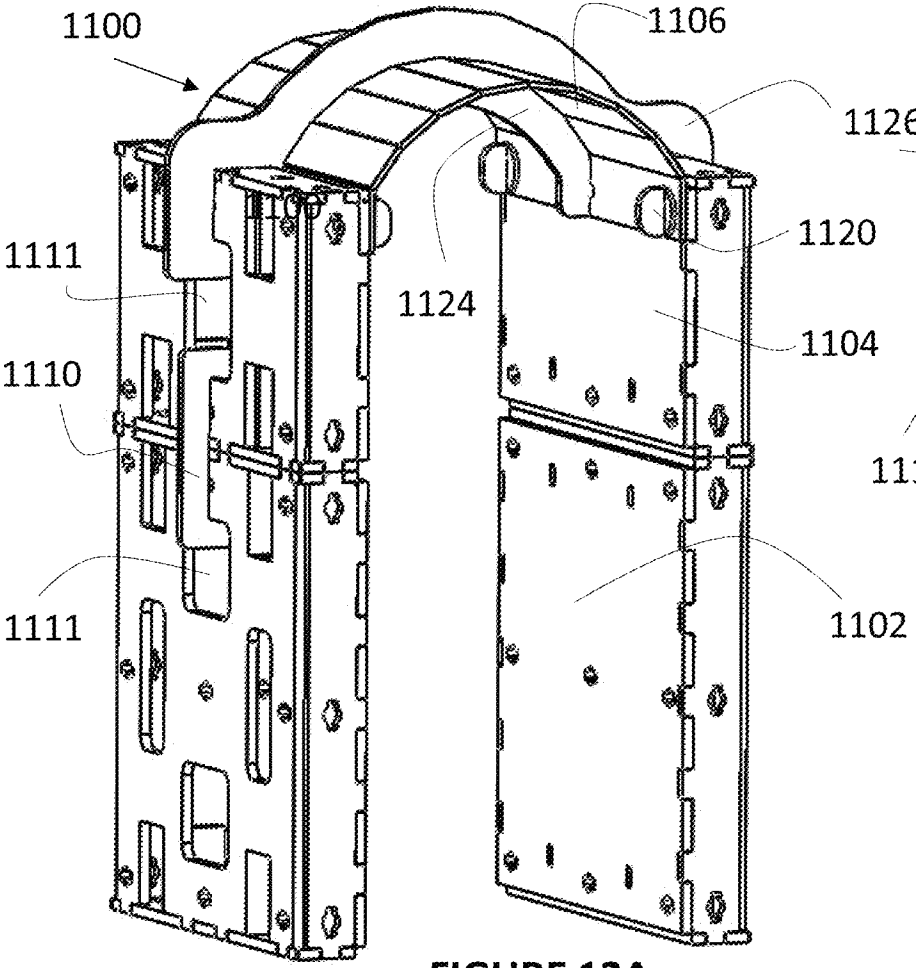
Figure 12D:
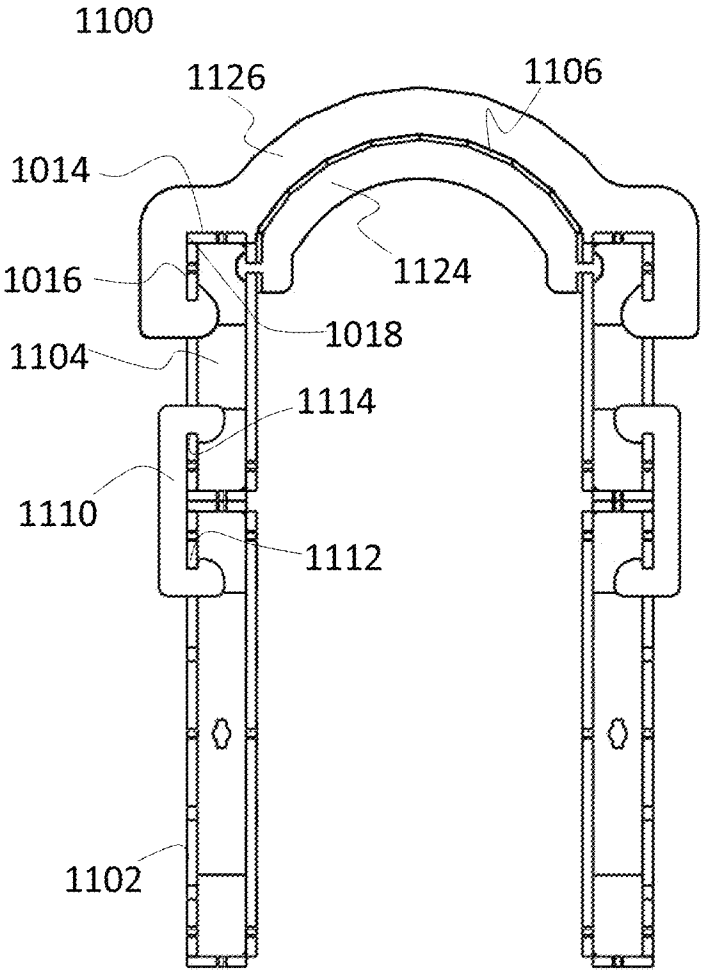
Figure 12C:
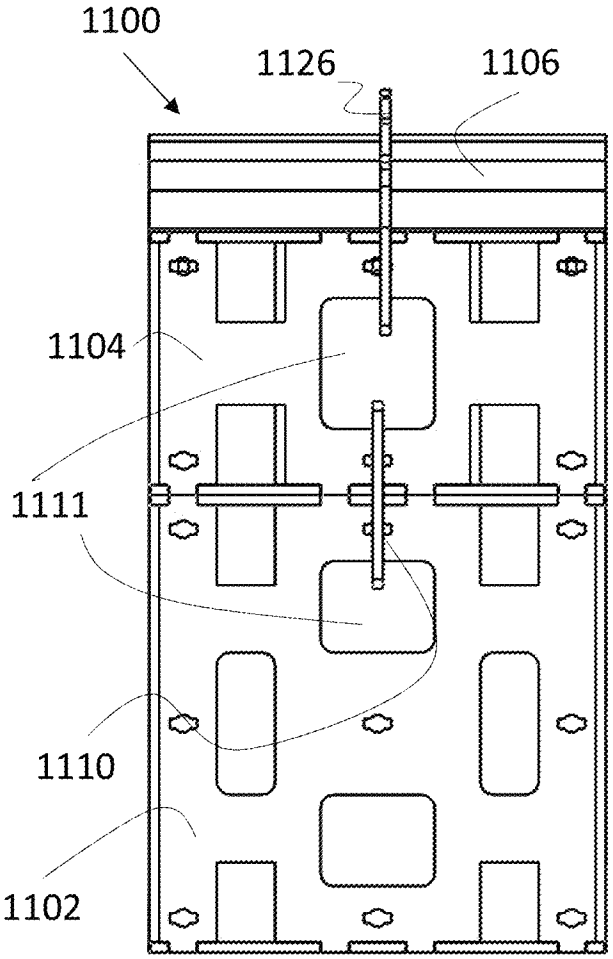

A side-reinforcing element 1110, similar to side-reinforcing element 1030 of FIG. 11C, reinforces the connection between each pair of larger and smaller rectangular wall elements. As seen in FIGS. 12A and 12D, connection portions 1034 (FIG. 11C) of side-reinforcing element 1110 are inserted into hollows 1111 in the connected rectangular wall elements 1102 and 1104. A wall portion 1112 of larger rectangular wall element 1102 is disposed within a first one of slots 1042 (FIG. 11C) and a wall portion 1114 of smaller rectangular wall element 1104 is disposed within a second one of slots 1042.

Figure 12E:
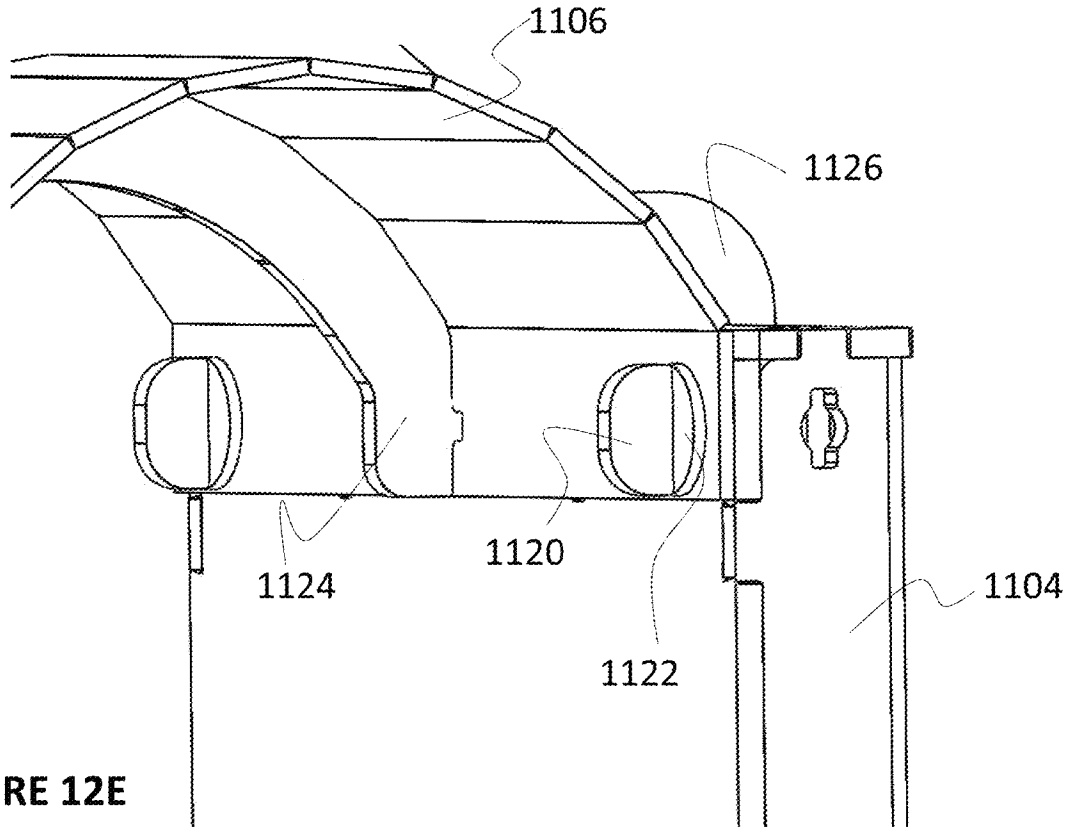

Arch element 1106 is connected to smaller rectangular wall elements 1104 along each connection end thereof, using connectors 1120, similar to connectors 900 of FIGS. 9A to 9C, as described herein. As seen in FIG. 12E, each connector 1120 may be reinforced by a connector-reinforcing element 1122, as shown in FIG. 11D.

A lower arch-reinforcing element 1124, similar to lower arch-reinforcing element 1000 of FIG. 11A, is disposed beneath arch element 1106. As seen in FIG. 12D, neck portions 1006 (FIG. 11A) of lower arch-reinforcing element 1124 extend through aligned bores in smaller rectangular wall elements 1104 and in arch element 1106, such that engagement protrusions 1104 (FIG. 11A) are disposed within the smaller rectangular wall elements. A lower surface of arch element 1106 rests against an upper surface of the arched portion 1002 (FIG. 11A) of lower arch-reinforcing element 1124.

An upper arch-reinforcing element 1126, similar to upper arch-reinforcing element 1010 of FIG. 1B, is disposed above arch element 1106. As seen in FIGS. 12A and 12D, horizontal portions 1014 (FIG. 12B) each engage an upper surface of a smaller rectangular wall element 1104, and vertical portions 1016 (FIG. 12B) each engage a side surface of the smaller rectangular wall element, such that a corner of the smaller rectangular wall element is situated at inner corner 1018 (FIG. 12B).

Protrusions 1020 extend into hollows 1111 of the wall elements, such that each slot 1022 receives a wall portion 1134 of smaller rectangular wall elements 1104. An upper surface of arch element 1106 engages a lower surface of arched portion 1012 of upper arch-reinforcing element 1126.

It is further appreciated that while the illustrated embodiments show connection of walls of two different structural element to each other using the inventive connectors, the same process is equally applicable to connection of two wall portions of a single structural element, provided that the connector-receiving bores thereof can be aligned with one another.

For the purposes of this specification and the claims that follow, the term "substantially" is defined as "at least 90%" of the related quantity. For example, "substantially perpendicular" means at least 90% perpendicular, or having an angle in the range of 81° to 99°.

It should be understood that the use of "and/or" is defined inclusively such that the term "a and/or b" should be read to include the sets: "a and b," "a or b," "a," "b."

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

It will be appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification, are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

The invention claimed is:

1. A modular construction system, comprising:

(a) first and second structural elements, each including:
  (i) a first wall including at least one throughgoing connector-receiving bore; and
  (ii) a second wall, perpendicular to said first wall, said second wall having at least one portal formed therein;

(b) first wall connector, comprising:
  (i) longitudinal body portion arranged along a longitudinal axis and having a first width, in a direction transverse to said longitudinal axis,
  (ii) a base surface facing toward one end of said longitudinal body portion, said base surface having a second width in a direction transverse to said longitudinal axis, said second width being greater than said first width; and
  (iii) an engagement surface facing toward said base surface and spaced therefrom along said longitudinal body portion, said engagement surface having a third width in said direction transverse to said longitudinal axis, said third width being greater than said first width, said first wall connector adapted be disposed within said connector-receiving bores of said first walls of said first and second structural elements, such that said longitudinal body portion is disposed within said bores and said base surface and said engagement surface engage said first walls of said first and second structural elements, thereby to form a first connection of said first and second structural elements; and (c) a second wall connector, comprising:
  (i) a longitudinal portion having first and second ends;
  (ii) first and second transverse connection portions extending from each of said first and second ends, respectively, said first transverse connection portion adapted to be received in said portal of said first structural element, and said second transverse connection portion adapted to be received in said portal of said second structural elements, when said second walls of said first and second structural elements are flush with each other, with said longitudinal portion being external to said first and second structural elements, thereby to form a second, reinforcing connection of said first and second structural elements.

2. The modular construction system of claim 1, wherein a distance between said base surface and said engagement surface, along said longitudinal axis of said longitudinal body portion, is equal to a sum of thicknesses of said first walls of said first and second structural elements.

3. The modular construction system of claim 1, wherein at least one of said first and second structural elements includes at least one non-planar wall.

4. The modular construction system of claim 3, wherein said non-planar wall is an arched wall.

5. A three dimensional structure constructed using the modular construction system of claim 1, wherein:

said first and second structural element are arranged such that said first walls of said first and second structural elements are disposed adjacent one another, with connector-receiving bores of said first walls being substantially aligned, and said second walls of said first and second structural elements being substantially flush with one another;

said first walls of said first and second structural elements are connected to each other by said first wall connector, such that:

said base surface is disposed adjacent a surface of said first wall of said first structural element;

said engagement surface is disposed adjacent a surface of said first wall of said second structural element; and a segment of said longitudinal body portion, between said base surface and said engagement surface, extends through said substantially aligned connector-receiving bores of said first walls; and said second walls of said first and second structural elements are connected to each other by said second wall connector, such that said first transverse connection portion extends into said portal of said second wall of said first structural element, said second transverse connection portion extends into said portal of said second wall of said second structural element, and said longitudinal portion of said second wall connector extends adjacent said second walls of said first and second structural elements, from an exterior of said first and second structural elements.

6. The three dimensional structure of claim 5, wherein surfaces of said first walls of said first and second structural elements engage one another.

7. The three dimensional structure of claim 5, wherein said longitudinal axis of said first wall connector is perpendicular to said surfaces of said first walls engaging said base surface and said engagement surface.

8. The three dimensional structure of claim 5, wherein said longitudinal portion of said first wall connector is arranged in a perpendicular direction to said longitudinal portion of said second wall connector.

9. The three dimensional structure of claim 5, wherein said longitudinal portion of said first wall connector is arranged in a parallel direction to said longitudinal portion of said second wall connector.

10. The modular construction system of claim 1, wherein said first and second structural elements, said first wall connector, and said second wall connector are formed of a single material.

11. The modular construction system of claim 1, wherein:

a first portal distance is defined between an edge of a first said portal formed in said first structural element and an edge of said second wall of said first structural element;

a second portal distance is defined between an edge of a second said portal formed in said second structural element and an edge of said second wall of said second structural element;

a connector distance is defined between adjacent edges of said first and second transverse connection portions; and said connector distance is equal to, or smaller than, a sum of said first portal distance and said second portal distance.

12. A method for building a three dimensional structure using the modular construction system of claim 1, the method comprising:

positioning said first and second structural elements, such that said first walls are adjacent and parallel to one another with said connector-receiving bores of said first walls being aligned, and said second walls are flush with one another;

connecting said first walls of said first and second structural elements by inserting said first wall connector into said aligned connector-receiving bores, until said base surface and said engagement surface are adjacent distal surfaces of said first walls of said first and second structural elements, and said longitudinal portion of said first wall connector extends through said aligned connector-receiving bores; and connecting said second walls of said first and second structural elements, using said second wall connector, by inserting said first transverse connection portion into said portal of said second wall of said first structural element, inserting said second transverse connection portion into said portal of said second wall of said second structural element, with said longitudinal portion of said second wall connector extending adjacent said second walls of said first and second structural elements, from an exterior of said first and second structural elements.

13. The method of claim 12, wherein, following said connecting of said first walls, said first walls of said first and second structural elements have substantially no degree of freedom in a direction along said longitudinal axis of said first wall connector.

14. A modular construction system, comprising:

(a) first and second structural elements, each including:

(i) a first wall including at least one throughgoing connector-receiving bore, the connector-receiving bore having a first dimension in a first axial direction, and a second dimension in a second axial direction, perpendicular to said first axial direction, said first dimension being greater than said second dimension; and (ii) a second wall, perpendicular to said first wall, said second wall having at least one portal formed therein;

(b) a first wall connector, comprising:

(i) a longitudinal body portion arranged along a longitudinal axis and having a first width, in a direction transverse to said longitudinal axis, said longitudinal body having a head end and a tail end, said first width being equal to or smaller than said second dimension of said connector-receiving bores;

(ii) a head portion disposed at said head end of said longitudinal body portion, said head portion including a base surface facing toward said tail end of said longitudinal body portion, said base surface having a second width in a direction transverse to said longitudinal axis, said second width being greater than said first width and being equal to, or smaller than, said first dimension of said connector-receiving bores; and (iii) a pair of protrusions, extending outwardly from said longitudinal body portion in said direction transverse to said longitudinal axis, said protrusions being disposed, along said longitudinal body portion, between said base surface of said head portion and said tail end of said longitudinal body portion, said protrusions including an engagement surface facing toward said base surface and having a third width in said direction transverse to said longitudinal axis, said third width being greater than said first width, said first wall connector adapted be disposed within said connector-receiving bores of said first walls of said first and second structural elements, thereby to form a first connection of said first and second structural elements; and (c) a second wall connector, comprising:

(i) a longitudinal portion having first and second ends;

(ii) a transverse connection portion extending from each of said first and second ends and terminating at a protrusion distal to said longitudinal portion, such that a slot is formed between said protrusion and said longitudinal portion, said second wall connector adapted to receive, in each of said slots, a portion of said second wall surrounding said portal of one of said first and second structural elements, thereby to form a second, reinforcing connection of said first and second structural elements.

15. The modular construction system of claim 14, wherein said first and second structural elements, said first wall connector, and said second wall connector are formed of a single material.

16. The modular construction system of claim 14, wherein:

a first portal distance is defined between an edge of a first said portal formed in said first structural element and an edge of said second wall of said first structural element;

a second portal distance is defined between an edge of a second said portal formed in said second structural element and an edge of said second wall of said second structural element;

a connector distance is defined between ends of said slots of said second wall connector, adjacent said transverse connection portions; and said connector distance is equal to, or smaller than, a sum of said first portal distance and said second portal distance.

17. A three dimensional structure constructed using the modular construction system of claim 14, wherein:

said first and second structural elements are arranged such that said first walls of said first and second structural elements are disposed adjacent one another with connector-receiving bores of said first walls being substantially aligned, and said second walls of said first and second structural elements being substantially flush with one another;

said first walls of said first and second structural elements are connected to each other by said first wall connector, such that:

said base surface of said first wall connector is disposed adjacent a surface of said first wall of said first structural element;

said engagement surface of said protrusions of said first wall connector is disposed adjacent a surface of said first wall of said second structural element; and a segment of said longitudinal body portion, between said base surface and said engagement surface, extends through said substantially aligned connector-receiving bores of said first walls; and said second walls of said first and second structural elements are connected to each other by said second wall connector, such that:

a portion of said second wall of said first structural element, at a perimeter of said portal, is disposed in a first slot of said second wall connector;

a portion of said second wall of said second structural element, at a perimeter of said portal, is disposed in a second slot of said second wall connector; and said longitudinal portion of said second wall connector extends adjacent said second walls of said first and second structural elements, from an exterior of said first and second structural elements.

18. The three dimensional structure of claim 17, wherein said longitudinal portion of said first wall connector is arranged in a perpendicular direction to said longitudinal portion of said second wall connector.

19. The three dimensional structure of claim 17, wherein said longitudinal portion of said first wall connector is arranged in a parallel direction to said longitudinal portion of said second wall connector.

20. A method for building a three dimensional structure using the modular construction system of claim 14, the method comprising:

positioning said first and second structural elements, such that said first walls are adjacent one another with said connector-receiving bores of said first walls being aligned, and said second walls are flush with one another;

connecting said first walls of said first and second structural elements, using said first wall connector, by:

aligning said first wall connector alongside said aligned connector-receiving bores, such that said head portion of said first wall connector is adjacent to one of said aligned connector-receiving bores, said first wall connector being oriented such that a width of said base surface is aligned with said first axial direction of said aligned connector-receiving bores and said longitudinal axis of said first wall connector is perpendicular to said first axial direction of said aligned connector-receiving bores;

inserting said first wall connector into said aligned connector-receiving bores, until said engagement surface is adjacent a surface of said first wall of said second structural element, and said head portion extends out of said aligned connector-receiving bores with said base surface being adjacent to a surface of said first wall of said first structural element; and rotating said first wall connector such that, following rotation, said width of said base surface is substantially perpendicular to said first axial direction, and said first and second walls are disposed between said base surface and said engagement surface; and connecting said second walls of said first and second structural elements, using said second wall connector, by:

inserting a first said transverse connection portion of said second wall connector into said portal of said second wall of said first structural element, such that said second wall of said first structural element is inserted within a first slot of said second wall connector; and pushing said second transverse connection portion of said second wall connector into said portal of said second wall of said second structural element, such that said second wall of said second structural element becomes wedged within a second slot of said second wall connector.

* * * * *